US008750767B2

(12) United States Patent
Sunayama

(10) Patent No.: US 8,750,767 B2
(45) Date of Patent: Jun. 10, 2014

(54) TONER REPLENISHMENT DEVICE AND IMAGE FORMING APPARATUS HAVING THE SAME

(75) Inventor: Satoshi Sunayama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 168 days.

(21) Appl. No.: 13/426,867

(22) Filed: Mar. 22, 2012

(65) Prior Publication Data

US 2012/0243886 A1 Sep. 27, 2012

(30) Foreign Application Priority Data

Mar. 22, 2011 (JP) ..... 2011-062169

(51) Int. Cl.
*G03G 15/08* (2006.01)

(52) U.S. Cl.
USPC ..... 399/258; 399/255

(58) Field of Classification Search
USPC ..... 399/27, 30, 254, 255, 258, 260
See application file for complete search history.

(56) References Cited

U.S. PATENT DOCUMENTS 6,654,569 B2 * 11/2003 Nozawa ..... 399/27
6,701,097 B1 * 3/2004 Carter et al. ..... 399/27
6,970,657 B2 * 11/2005 Suenaga et al. ..... 399/27
7,248,806 B2 * 7/2007 Askren et al. ..... 399/27
7,389,072 B2 * 6/2008 Hebner et al. ..... 399/260
7,756,432 B2 * 7/2010 Mase ..... 399/64

FOREIGN PATENT DOCUMENTS

JP 01080977 A * 3/1989
JP 2004191559 A * 7/2004
JP 2004191862 A * 7/2004
JP 2006106056 A * 4/2006
JP 2008-107502 5/2008

* cited by examiner

*Primary Examiner* — Robert Beatty
(74) *Attorney, Agent, or Firm* — Frommer Lawrence & Haug LLP

(57) ABSTRACT

A toner replenishment device includes a toner receiving port, a toner feed unit feeding toner from the toner receiving port into the device, a toner detector detecting that the device has been filled with a specified amount of the toner, an agitating member having an agitating blade and rotating so as to agitate the toner in the device, a position detector detecting a rotational position of the agitating member and generating a signal indicative thereof, and a recognition unit recognizing the rotational position based on the signal output from the position detector. The toner feed unit feeds the toner into the device when an end edge of the agitating blade is within a specified range, in which a flow path of the toner from the toner receiving port to the toner detector is not blocked by the agitating blade, based on the recognition performed by the recognition unit.

14 Claims, 14 Drawing Sheets

TONER REPLENISHMENT DEVICE AND IMAGE FORMING APPARATUS HAVING THE SAME

INCORPORATION BY REFERENCE

This application is based upon and claims the benefit of priority from the corresponding Japanese Patent application No. 2011-062169, filed Mar. 22, 2011, the entire contents of which are incorporated herein by reference.

FIELD

The present disclosure relates to a toner replenishment device that is replenished with toner from a toner containing body and relates to an image forming apparatus including the toner replenishment device.

BACKGROUND

Some image forming apparatuses form images using toner. A developing device supplies toner toward an image bearing member (photoconductor drum) on which an electrostatic latent image has been formed, thereby developing the electrostatic latent image. A toner containing body (toner container) is mounted in such an image forming apparatus in order to supply toner to the developing device to replenish the developing device with toner. Furthermore, in some cases a hopper, which relays a replenishment of the toner from the toner containing body to the developing device, is provided between the toner containing body and the developing device. Some image forming apparatuses detect the amount of toner in the hopper. Such image forming apparatuses are known.

Specifically, in such an image forming apparatus, a developing section and a toner cartridge are arranged side by side in the lateral direction. The developing section develops a latent image on the image bearing member using toner, and the toner cartridge supplies the toner with which the developing unit is replenished. The toner cartridge is removably mounted in the image forming apparatus. A communication opening and a control valve are provided between the toner cartridge and the developing section. The communication opening allows the toner to pass therethrough, and the control valve controls the amount of the toner allowed to pass through the communication opening. The developing section includes a toner transportation paddle and toner detection means. The toner transportation paddle having a comb-shaped film and a rectangular film drives the control valve, and the toner detection means, which is provided below the control valve, detects the toner. With the above-described structure, a state in which the amount of the toner has decreased to a certain level due to being used in a developing hopper is reliably estimated, and, when the developing hopper runs short of the toner, use of any more toner is prohibited, thereby preventing the quality of images from being degraded and a developing unit from being damaged.

In general, the toner replenishment device stores a large amount of toner in order to allow printing to be continued to some extent even when the toner container has run out of toner. When the toner replenishment device runs short of toner, the toner replenishment device is replenished with toner from the toner container.

However, when an excessive amount of the toner is fed into the toner replenishment device, the toner may overflow out of the toner replenishment device and contaminate the interior of the image forming apparatus. In order to suppress such an issue, detectors are provided in some cases. Such a detector contacts the toner in order to detect that the amount of the toner in the toner replenishment device has reached a specified amount and the toner replenishment device has been sufficiently (to such an extent that no overflow of the toner occurs) replenished with the toner.

In some toner replenishment devices, an agitating member (agitating paddle) that rotates so as to agitate and transport the toner is provided. In general, in order to entirely agitate the toner without leaving part of the toner unagitated, it is preferable that the agitating member agitate as large an area as possible. However, depending on the rotation angle of the agitating member, the agitating member may block a path of the toner from a toner receiving port, through which the toner supplied from the toner container is received, to the detector of the toner.

It is assumed that the toner receiving port is arranged, for example, on an upper surface of the toner replenishment device. In this case, when the position of the agitating member is above the detector so as to overlap the detector (when the agitating member is at such a position that the agitating member covers the detector like an umbrella), the toner from the toner container does not reach the detector. Thus, there is a problem in the event that the amount of the toner in the toner replenishment device has reached a specified amount but, depending on the rotation angle of the agitating member, cannot be detected. Particularly, when the amount of the toner in the toner replenishment device has reached the specified amount but cannot be detected, replenishment of the toner to the toner replenishment device from the toner container may be continued until the toner overflows out of the toner replenishment device.

Here, the toner detection means of the developing section of the image forming apparatus estimates a state in which the remaining amount of the toner has decreased, and does not detect that the developing section has been sufficiently replenished with the toner in an amount by which the toner in the toner replenishment device has reached the specified amount.

SUMMARY

Some embodiments of the present disclosure relate to a toner replenishment device that allows toner for replenishment to reach a detector without being blocked by an agitating body, and that can quickly and correctly detect that the toner has been sufficiently replenished so as to reach a specified amount. Some embodiments of the present disclosure also relate to an image forming apparatus equipped with the toner replenishment device.

A toner replenishment device according to an aspect of the present disclosure includes a toner receiving port through which toner is selectively fed into the toner replenishment device, a toner feed unit configured to feed the toner from the toner receiving port into the toner replenishment device, and a toner detector configured to use for detecting, by interaction with the toner, whether the toner replenishment device has been filled with a specified amount of the toner. The toner replenishment device also includes an agitating member that has an agitating blade, and rotates so as to agitate the toner in the toner replenishment device, wherein the agitating blade is positioned near the toner detector over certain rotational angles of the agitating member, a position configured to generate a signal indicative of a rotational position of the agitating member, and a recognition unit configured to recognize the rotational position of the agitating member based on the signal output from the position detector. In the toner replenishment device, the toner feed unit feeds the toner into the toner replenishment device when a position of an end edge of the agitating blade is such a position that the agitating blade does not block a flow path of the toner from the toner receiving port to the toner detector based on the recognition performed by the recognition unit.

An image forming apparatus according to another aspect of the present disclosure includes an image bearing member configured to bear a toner image on a circumferential surface thereof, a developing device that develops an electrostatic latent image formed on the circumferential surface of the image bearing member so as to form the toner image, a transfer section configured to transfers the toner image onto a sheet, a fixing unit configured to fix the toner image, which has been transferred onto the sheet, onto the sheet, a toner containing body that contains toner, and a toner replenishment device that receives the toner from the toner containing body and feeds the toner to the developing device. In the image forming apparatus, the toner replenishment device includes a toner receiving port through which toner is selectively fed into the toner replenishment device, an toner feed unit configured to feed the toner from the toner receiving port into the toner replenishment device, and a toner detector configured to use for detecting, by interaction with the toner, whether the toner replenishment device has been filled with a specified amount of the toner. The toner replenishment device also includes an agitating member has an agitating blade, and rotates so as to agitate the toner in the toner replenishment device, wherein the agitating blade is positioned near the toner detector over certain rotational angles of the agitating member, a position detector configured to generate a signal indicative of a rotational position of the agitating member, and a recognition unit configured to recognize the rotational position of the agitating member based on the signal output from the position detector. In the toner replenishment device, the toner feed unit feeds the toner into the toner replenishment device when a position of an end edge of the agitating blade is within a specified range based on the recognition performed by the recognition unit. The agitating blade does not block a flow path of the toner from the toner receiving port to the toner detector while the end edge thereof is in the specified range.

The above and other objects, features, and advantages of various embodiments of the present disclosure will be more apparent from the following detailed description of embodiments taken in conjunction with the accompanying drawings.

Throughout the specification and claims, the following terms take at least the meanings explicitly associated herein, unless the context dictates otherwise. The meanings identified below do not necessarily limit the terms, but merely provide illustrative examples for the terms. In the text, the terms "comprising", "comprise", "comprises" and other foams of "comprise" can have the meaning ascribed to these terms in U.S. Patent Law and can mean "including", "include", "includes" and other forms of "include." The term "contains" or other fowls thereof, as used herein, is synonymous with "comprises" or "includes"; it is similarly inclusive or open-ended and does not exclude additional, unrecited elements or steps. The term "composed" or other forms thereof, as used herein, denotes that some embodiments or implementations may exclude unspecified materials, compounds, elements, components, or the like (e.g., other than, for example, impurities, trace compounds, or the like), and that some embodiments may not exclude other unspecified materials, compounds, elements, components, or the like; for example, other unspecified materials, compounds, elements, may be included provided they do not adversely affect the desired characteristics of the specified material, compound, element, component, or the like, or otherwise do not materially alter the basic and novel characteristics of the embodiment or implementation. The phrase "an embodiment" as used herein does not necessarily refer to the same embodiment, though it may. In addition, the meaning of "a," "an," and "the" include plural references; thus, for example, "an embodiment" is not limited to a single embodiment but refers to one or more embodiments. As used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise.

It will be appreciated by those skilled in the art that the foregoing brief description and the following detailed description are exemplary (i.e., illustrative) and explanatory of the subject matter of the present disclosure, but are not intended to be restrictive thereof or limiting of the advantages which can be achieved by the present disclosure in various implementations. Additionally, it is understood that the foregoing summary and ensuing detailed description are representative of some embodiments of the present disclosure, and are neither representative nor inclusive of all subject matter and embodiments within the scope of the present disclosure. Thus, the accompanying drawings, referred to herein and constituting a part hereof, illustrate embodiments of this disclosure, and, together with the detailed description, serve to explain principles of embodiments of the present disclosure.

Various features of novelty which characterize various aspects of the disclosure are pointed out in particularity in the claims annexed to and forming a part of this disclosure. For a better understanding of the disclosure, operating advantages and specific objects that may be attained by some of its uses, reference is made to the accompanying descriptive matter in which exemplary embodiments of the disclosure are illustrated in the accompanying drawings in which corresponding components are identified by the same reference numerals.

BRIEF DESCRIPTION OF THE DRAWINGS

The following detailed description, given by way of example, but not intended to limit the disclosure solely to the specific embodiments described, may best be understood in conjunction with the accompanying drawings, in which.

DETAILED DESCRIPTION OF EMBODIMENTS

Reference will now be made in detail to various embodiments of the disclosure, one or more examples of which are illustrated in the accompanying drawings. Each example is provided by way of explanation of the disclosure, and by no way limiting the present disclosure. In fact, it will be apparent to those skilled in the art that various modifications, combinations, additions, deletions and variations can be made in the present disclosure without departing from the scope or spirit of the present disclosure. For instance, features illustrated or described as part of one embodiment can be used in another embodiment to yield a still further embodiment. It is intended that the present disclosure covers such modifications, combinations, additions, deletions, applications and variations that come within the scope of the appended claims and their equivalents.

Various illustrative embodiments according to the present disclosure will be described below with reference to FIGS. 1 to 14. A first embodiment will be initially described with reference to FIGS. 1 to 12, and a second embodiment with then be described with reference to FIGS. 13 and 14. It should be understood that elements such as structures and arrangements described in each embodiment are only descriptive examples, and not intended to limit the scope of the disclosure. It will also be understood that reference to a "first embodiment" and a "second embodiment" is simply for ease of reference, and does not indicate that only these embodiments are with the scope of the present disclosure, nor that these embodiments are mutually exclusive. For example, those skilled in the art will understand that each of the first and second embodiments may be modified according to one or more features of the other embodiment, and further that various features of each embodiment may be used to provide yet further embodiments.

Figure 1:
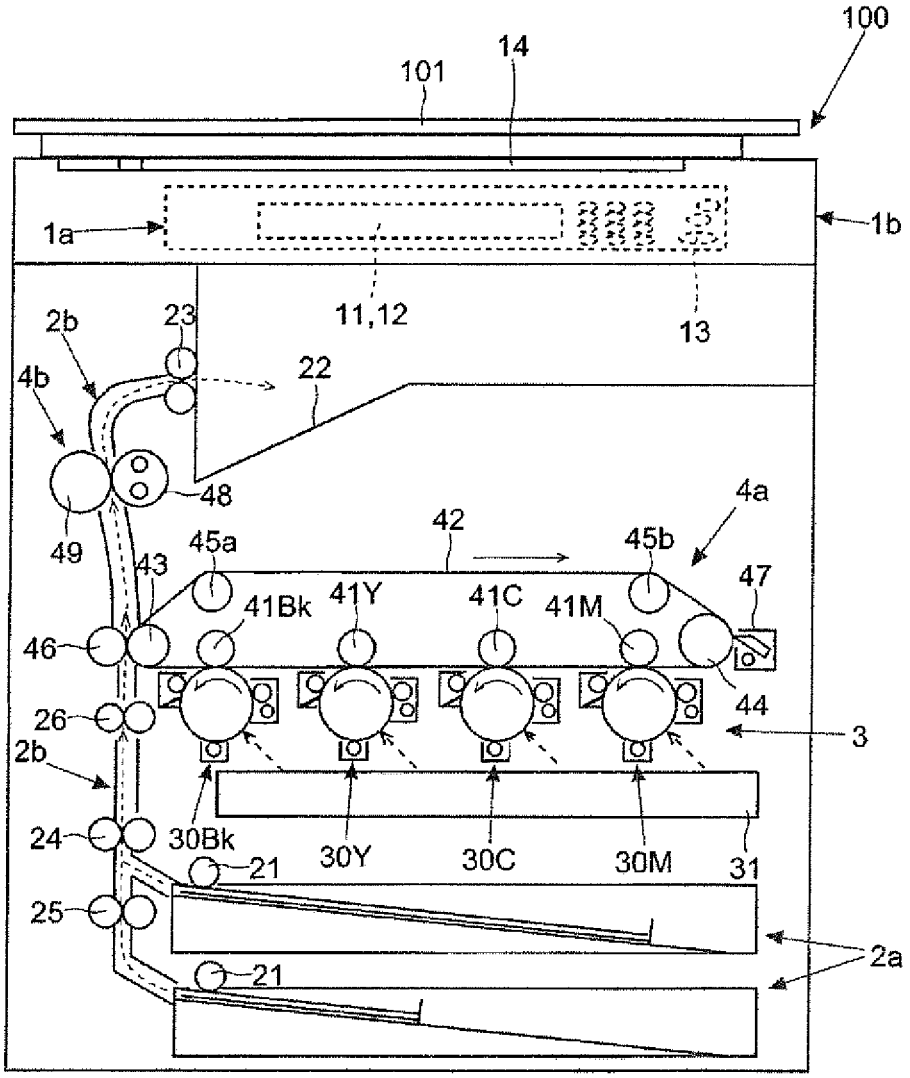
FIG. 1 is a sectional view illustrating the structure of a multi-functional peripheral according to a first embodiment.
Figure 2:
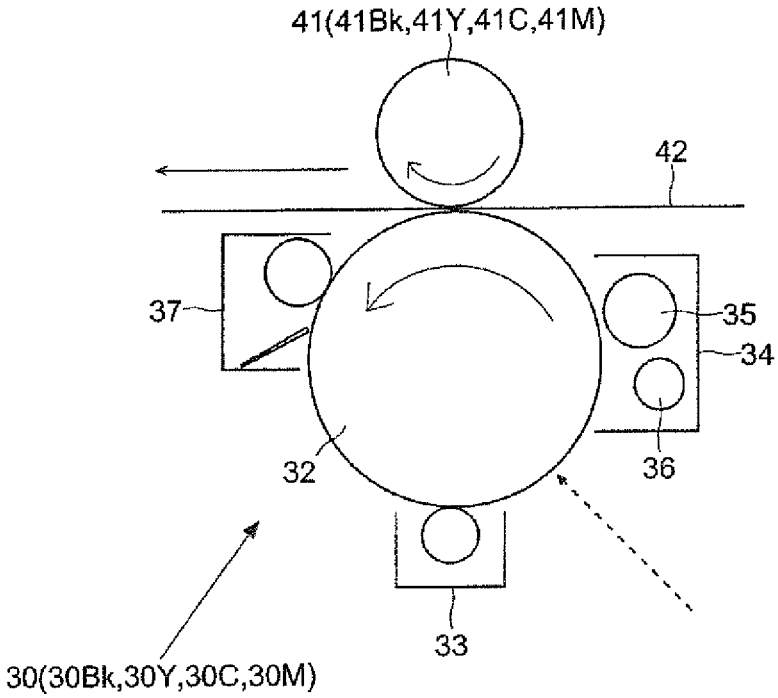
FIG. 2 is a sectional view of an image forming unit according to the first embodiment.

The first illustrative embodiment is initially described as follows. In the ensuing description of this embodiment, an electrophotographic tandem color multi-functional peripheral (corresponding to an image forming apparatus) is described as an example of one illustrative implementation. Other implementations may be embodied as, for example, a single-function peripheral, such as a copier, a printer, or a facsimile apparatus. FIG. 1 is a sectional view illustrating the structure of a multi-functional peripheral 100 according to the first embodiment. FIG. 2 is a sectional view of an image forming unit 30 according to the first embodiment.

As illustrated in FIG. 1, the multi-functional peripheral 100 according to the present embodiment includes a document cover 101 at an uppermost portion thereof. The multi-functional peripheral 100 also includes an operation panel 1*a*, an image reading unit 1*b*, sheet feed units 2*a*, a transportation unit 2*b*, an image forming section 3, an intermediate transfer unit 4*a*, a fixing unit 4*b*, and so forth.

As indicated by broken lines in FIG. 1, the operation panel 1*a* is provided at a front upper portion of the multi-functional peripheral 100. The operation panel 1*a* includes a liquid crystal display unit 11 that displays the state of the multi-functional peripheral 100, a variety of messages, and a setting screen. A touch panel unit 12 (for example, a resistive film touch panel) is provided on an upper surface of the liquid crystal display unit 11. The touch panel unit 12 detects a position or coordinates of a part where the liquid crystal display unit 11 is pressed, thereby recognizing a setting button pressed in the screen. A variety of hardware buttons such as a start button 13 are also provided in the operation panel 1*a*. The start button 13 instructs the start of execution of copying and other functions.

The document cover 101 is pivoted on the rear side of the sheet of FIG. 1 and openable in the up-down direction of the sheet of FIG. 1. The document cover 101 presses an original document sheet placed on a contact glass 14 for reading a placed original document when copying a document. The image reading unit 1*b* reads the original document sheet and forms image data of the original document sheet. The image reading unit 1*b* includes therein optical components (not shown) such as an exposure lamp, mirrors, lenses, and an image sensor (for example, a charge-coupled device (CCD), or a CMOS image sensor). A document feeding device may be provided instead of the document cover 101. With the document feeding device, sheets of an original document are automatically continuously fed to a reading position of the image reading unit 1*b* one by one.

Using the optical components of the image reading unit 1*b*, a sheet of an original document placed on the contact glass 14 is illuminated, and the light reflected by the sheet of the original document is received by the image sensor. The output values of pixels of the image sensor are converted into digital values (A/D conversion), thereby generating image data. The multi-functional peripheral 100 can perform printing in accordance with image data obtained by reading with the reading unit 1*b* (thereby carrying out a copying function).

A variety of sheets such as, for example, sheets of copy paper, overhead projector (OHP) sheets, label sheets are stored in the sheet feed units 2*a*. A sheet is fed into the transportation unit 2*b* using a sheet feed roller 21 rotated by a drive mechanism (not shown) such as a motor. The transportation unit 2*b* transports the sheet in the multi-functional peripheral 100 therethrough. The sheet supplied from one of the sheet feed units 2*a* is introduced to a discharge tray 22 along the transportation unit 2*b* through the intermediate transfer unit 4*a* and the fixing unit 4*b*. Along the transportation unit 2*b*, transportation roller pairs 24 and 25, a registration roller pair 26, and the like are provided. The registration roller pair 26 causes the sheet being transported to wait before the intermediate transfer unit 4*a* so as to feed the sheet at an adjusted timing.

As illustrated in FIGS. 1 and 2, the multi-functional peripheral 100 includes the image forming section 3 that forms toner images in accordance with image data of images to be formed. The image forming section 3 includes the image forming units 30 each provided for one of four colors. Specifically, the multi-functional peripheral 100 includes an image forming unit 30Bk for forming black images, an image forming unit 30Y for forming yellow images, an image forming unit 30C for forming cyan images, an image forming unit 30M for forming magenta images, and an exposure unit 31.

The image forming units 30Bk to 30M will be described in detail below with reference to FIG. 2. The image forming units 30Bk to 30M each fundamentally have the same structure despite a difference in color of toner images formed thereby. Thus, in the description below, reference signs Bk, Y, C, and M corresponding to the respective image forming units 30 are omitted except when a particular one of the image forming units 30 is described.

Each of the image forming units 30 includes a photoconductor drum 32 as an image bearing member, which has a photo-sensitive layer on an outer circumferential surface. Each of the photoconductor drums 32 can bear a toner image on the circumferential surface, and is rotated at a specified processing speed. Each photoconductor drum 32 is charged at a certain potential by a charger 33. The exposure unit 31 disposed at a bottom part of the image forming section 3 converts input image signals having been separated in terms of color into corresponding beam signals. Laser beams (indicated by broken lines in FIGS. 1 and 2), which are converted beam signals, are output so as to scan the photoconductor drums 32, which have been charged, thereby forming electrostatic latent images on the surfaces of the photoconductor drums 32.

Each developing devices 34 contains developer for the corresponding color. Each of the developing devices 34 includes therein a developing roller 35, an agitating roller 36, and the like. The developing roller bears a thin layer of toner and rotates. The agitating roller 36 rotates so as to agitate toner in the developing device 34. The developing device 34 may further include one or plurality of rollers therein. Each developing device 34 supplies toner onto the electrostatic latent image on the photoconductor drum 32 so as to develop the image. The photoconductor drums 32 are cleaned using corresponding cleaning devices 37.

Referring back to FIG. 1, the intermediate transfer unit 4*a* and the fixing unit 4*b* of the multi-functional peripheral 100 will be described. The intermediate transfer unit 4*a* performs secondary transfer of the toner images, which have been formed on the photoconductor drums 32 and have undergone primary transfer, onto a sheet. The intermediate transfer unit 4*a* includes primary transfer rollers 41Bk to 41M, an intermediate transfer belt 42, a drive roller 43, a driven roller 44, tension rollers 45*a* and 45*b*, a secondary transfer roller 46, a belt cleaning device 47, and so forth. The primary transfer rollers 41Bk to 41M and the corresponding photoconductor drums 32 pinch the endless intermediate transfer belt 42. A primary transfer voltage is applied to each of the primary transfer rollers 41Bk to 41M, and the toner image formed on each of the photoconductor drums 32 is transferred onto the intermediate transfer belt 42.

The intermediate transfer belt 42 is stretched by the drive roller 43 and so forth, and rotated by rotation of the drive roller 43 connected to a drive mechanism (not shown) such as a motor. The drive roller 43 and the secondary transfer roller 46 pinch the intermediate transfer belt 42. The toner images (black, yellow, cyan, and magenta) formed by the respective image forming units 30 are sequentially precisely superposed on the intermediate transfer belt 42 through primary transfer, and then transferred onto the sheet by the secondary transfer roller 46 to which a specified voltage is applied.

The fixing unit 4*b* is disposed on the downstream side in the sheet transportation direction relative to the intermediate transfer unit 4*a* and heats and pressurizes the toner images transferred onto the sheet through secondary transfer to fix the toner images. The fixing unit 4*b* mainly includes a fixing roller 48 and a pressure roller 49. The fixing roller 48 includes a heat source thereinside, and the pressure roller 49 is pressed against the fixing roller 48. The fixing roller 48 and the pressure roller 49 form a nip therebetween. The sheet onto which the toner images have been transferred is heated and pressurized while the sheet passes through the nip. As a result, the toner images are fixed onto the sheet. The sheet onto which the toner images have been fixed is delivered to the discharge tray 22 by a discharge roller pair 23. Thus, an image forming process is complete.

An illustrative hardware configuration of the multi-functional peripheral 100 according to the first embodiment will now be described with reference to FIG. 3. Particularly, FIG. 3 is a block diagram illustrating an example of the hardware configuration of the multi-functional peripheral 100 according to some implementations of the first embodiment.

Figure 3:
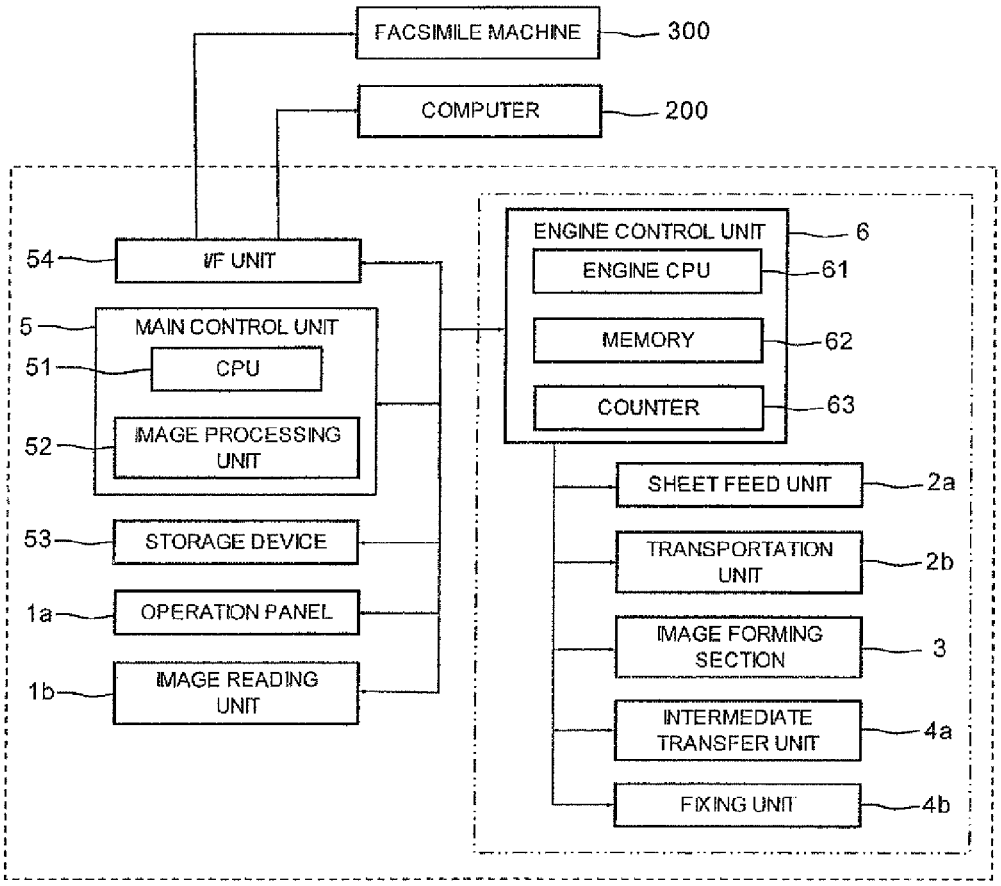
FIG. 3 is a block diagram illustrating an example of the hardware configuration of the multi-functional peripheral according to the first embodiment.

As illustrated in FIG. 3, the multi-functional peripheral 100 according to the present embodiment includes a main control unit 5 therein. The main control unit 5 controls components of the multi-functional peripheral 100. The main control unit 5 includes, for example, a central processing unit (CPU) 51, an image processing unit 52, and so forth.

The CPU 51 serves as a central processor and performs calculation and control of components of the multi-functional peripheral 100 in accordance with control programs stored in a storage device 53 (corresponding to a storage unit) to be loaded. The storage device 53 includes a combination of volatile and non-volatile storage devices such as a read only memory (ROM), a random access memory (RAM), a flash ROM, and a hard disk drive (HDD). The storage device 53 stores, for example, the control programs of the multi-functional peripheral 100, control data, and so forth.

The main control unit 5 is connected to the operation panel 1*a* and so forth, and controls operations of the components of the multi-functional peripheral 100 in accordance with the control programs and data in the storage device 53 so as to cause image formation to be adequately performed. The main control unit 5 is also connected to an interface (I/F) unit 54. The I/F unit 54 is a communication interface for communicating with a computer 200 (for example, a personal computer or a server) and a facsimile machine 300 through a network, cables, and a public circuit. The computer is a source of printing data including image data for printing and setting data for printing. The I/F unit 54 receives image data and setting data for printing from the computer 200 and the facsimile machine 300.

In accordance with settings, the image processing unit 52 performs a variety of image processing on image data of the original document read by the image reading unit 1*b* and image data received from the computer 200 and the facsimile machine 300. The image processing includes an increase and a decrease in size, contrast conversion, conversion of a data format, and so forth. The image processing unit 52 transmits the image data on which image processing has been performed to the exposure unit 31 (see FIG. 1). Upon reception of the image data, the exposure unit 31 performs scanning on the photoconductor drums 32 (copying, printing and facsimile functions). The main control unit 5 can cause image data of the original document read by the image reading unit 1*b* to be transmitted to the external computer 200 or the facsimile machine 300 through the I/F unit 54 (scanning and facsimile functions).

The main control unit 5 is connected to an engine control unit 6 (corresponding to a recognition unit and a control unit). The engine control unit 6 actually controls operations of an engine unit 60 relating to printing. The engine unit 60 includes the sheet feed units 2*a*, the transportation unit 2*b*, the image forming section 3, the intermediate transfer unit 4*a*, the fixing unit 4*b* and so forth. The main control unit 5 issues an instruction of execution of printing to the engine control unit 6, which controls components of the engine unit 60 in accordance with the instruction so as to perform printing. The engine control unit 6 performs control relating to printing through controls including the following controls: sheet feed control, sheet transportation control, toner image formation control in the image forming section 3; and fixing temperature control in the fixing unit 4*b* performed by an operation such as turning on or off of the motor and the like that rotate a variety of rotating members in the sheet feed units 2*a*, the transportation unit 2*b*, the image forming section 3, the intermediate transfer unit 4*a*, and the fixing unit 4*b*.

The engine control unit 6 is a substrate that includes an engine CPU 61, a memory 62 (corresponding to a memory unit), and so forth. The engine CPU 61 is a processor that performs calculation and processes in accordance with programs and data in the memory 62 so as to control operations of the engine unit 60. The memory 62 uses a ROM and a RAM in which control programs and data relating to image formation are stored. The engine control unit 6 (engine CPU 61) controls operations of components of the engine unit 60 in accordance with control programs and control data relating to printing in the memory 62 such that image formation is adequately performed. The memory 62 also stores a program and data relating to toner replenishment. The engine control unit 6 performs control relating to toner replenishment (details of toner replenishment will be described later). A counter 63, which counts variety of values relating to control, may be provided in the engine control unit 6.

In the following example of the present embodiment, the engine control unit 6, which is dedicated to control of components performing printing, is provided separately from the main control unit 5. However, in various implementations, the engine control unit 6 and the main control unit 5 may be integrated with each other, and the main control unit 5 may be made to perform functions and processes of the engine control unit 6.

Figure 4:
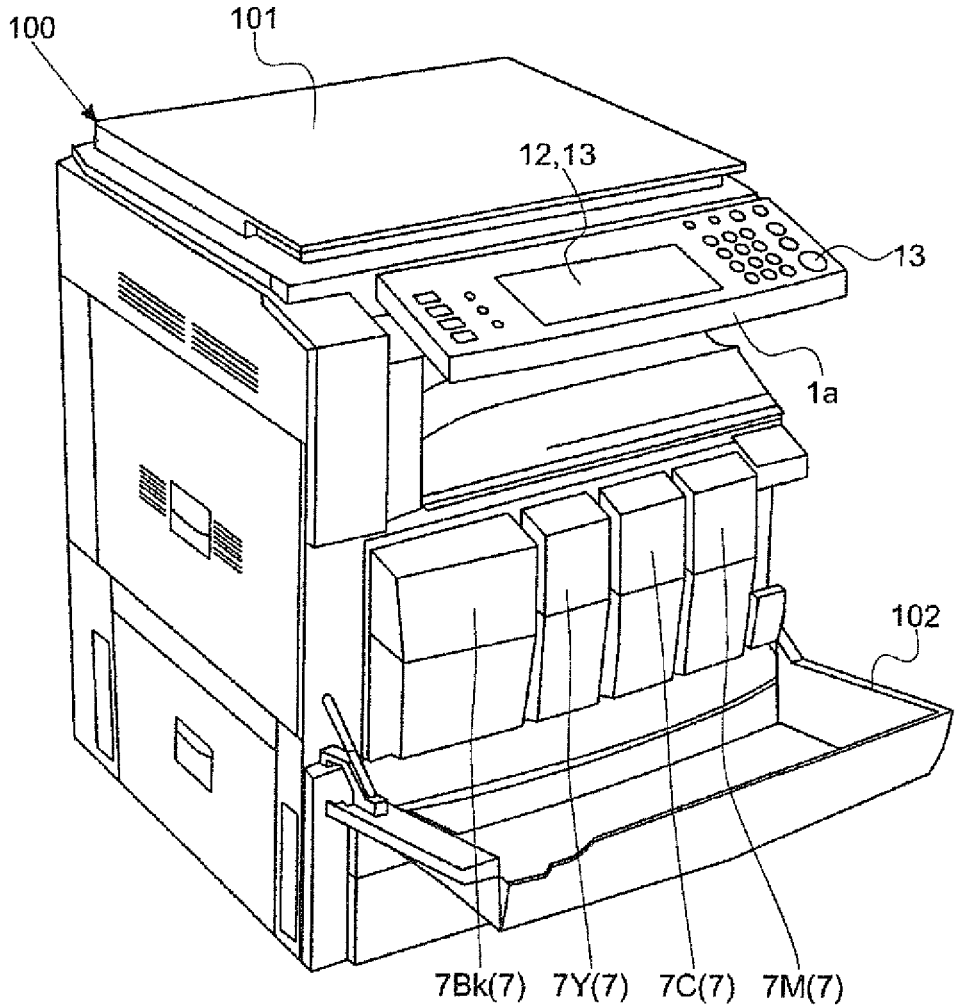
FIG. 4 is a perspective view of the multi-functional peripheral according to the first embodiment.
Figure 5:
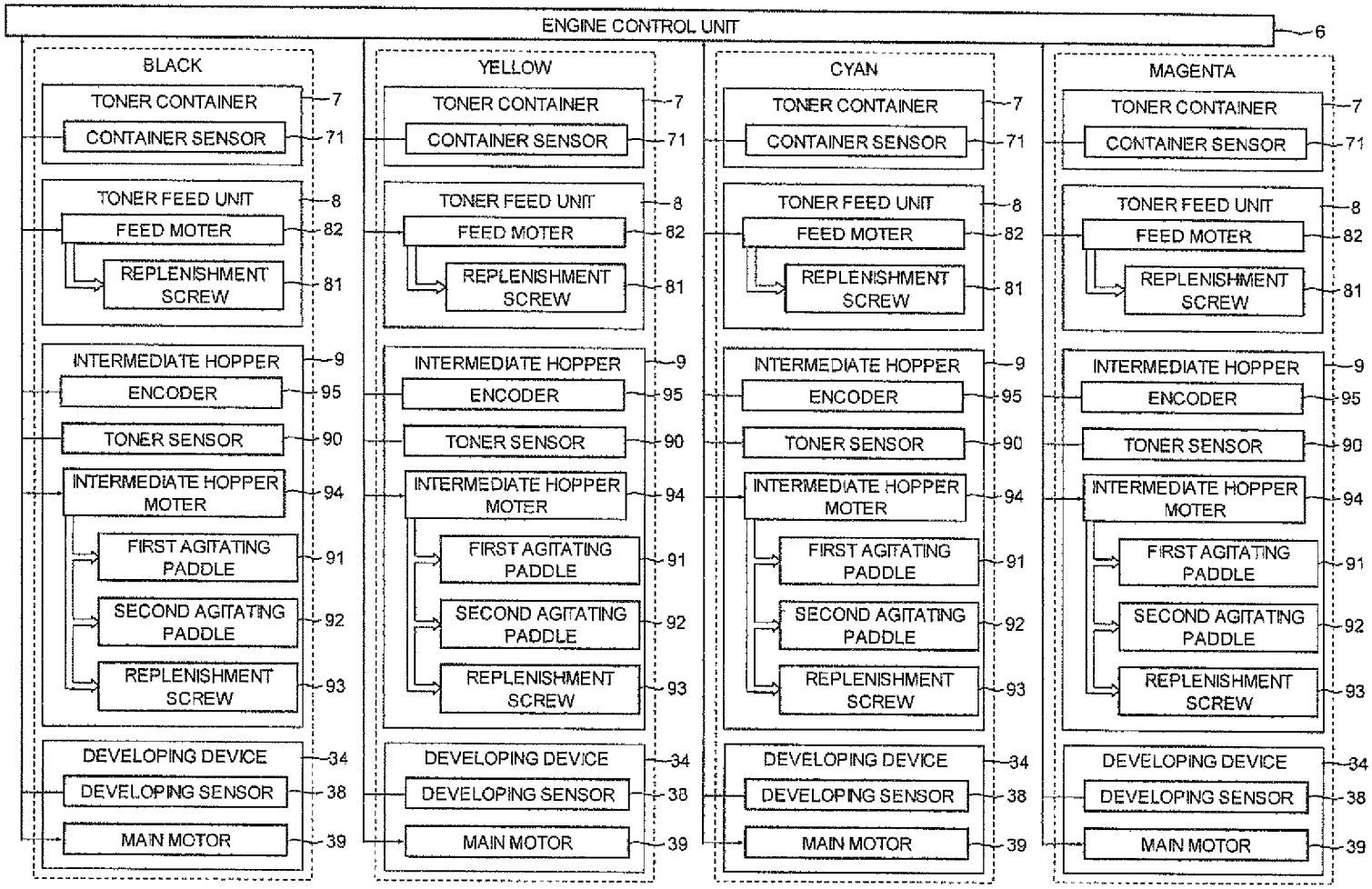
FIG. 5 is a block diagram illustrating the configuration relating to toner replenishment according to the first embodiment.
Figure 6:
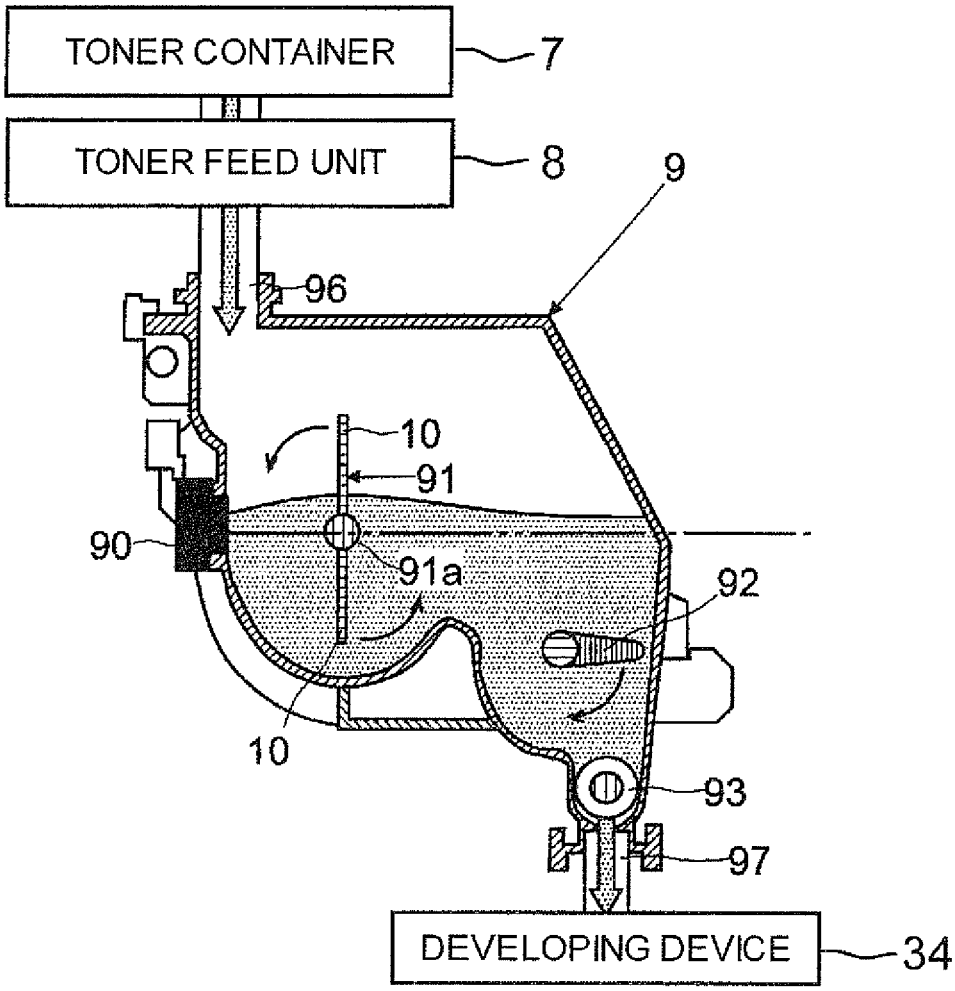
FIG. 6 is a sectional view illustrating an intermediate hopper provided in the multi-functional peripheral according to the first embodiment.
Figure 7:
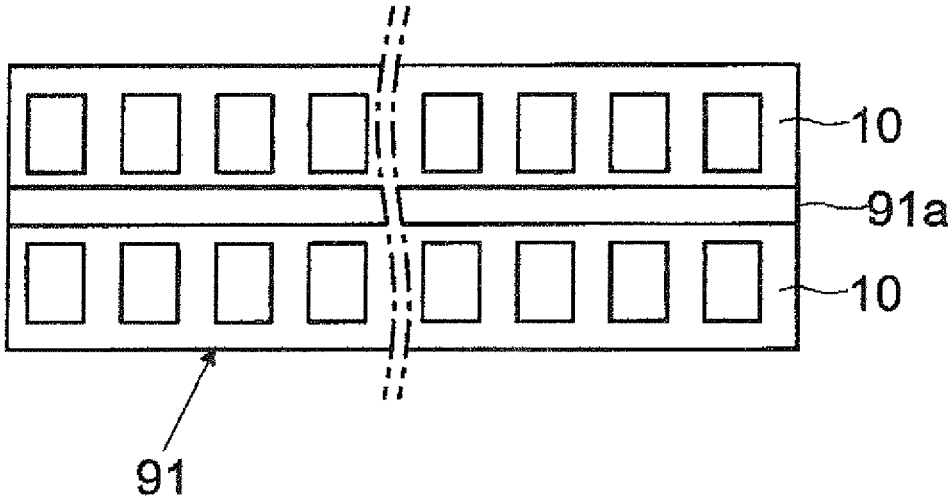
FIG. 7 is a plan view illustrating an example of a first agitating paddle of the intermediate hopper according to the first embodiment.

Replenishment of the developing devices 34 with toner in the multi-functional peripheral 100 according to some illustrative implementations of the first embodiment will now be described with reference to FIGS. 4 to 7. FIG. 4 is a perspective view of the multi-functional peripheral 100 according to the first embodiment. FIG. 5 is a block diagram illustrating the configuration relating to toner replenishment according to the first embodiment. FIG. 6 is a sectional view illustrating an intermediate hopper 9 provided in the multi-functional peripheral 100 according to the first embodiment. FIG. 7 is a plan view illustrating an example of a first agitating paddle 91 of the intermediate hopper 9 according to the first embodiment.

FIG. 4 illustrates an example of the interior of the multi-functional peripheral 100 when a front cover 102 of the multi-functional peripheral 100 is open. Four toner containers 7 (corresponding to toner containing bodies) that are each provided for replenishment of a corresponding one of black, yellow, cyan, or magenta toners (7Bk for black, 7Y for yellow, 7C for cyan, and 7M for magenta) are mounted from the left to right in FIG. 4 in the multi-functional peripheral 100. Each developing device 34 is finally replenished with toner from a corresponding one of the toner containers 7. Since usage of black toner is generally large compared to that of the toners in other colors, the toner container 7Bk for black toner is made to be larger than the toner containers for the other colors. The toner containers 7 are removably mounted in the multi-functional peripheral 100. When a particular one of the toner containers 7 has run out of toner, that toner container 7 is replaced.

Referring next to FIG. 5, the configuration in which the developing devices 34 are replenished with toner from the toner containers 7 in the multi-functional peripheral 100 according to the present embodiment will be described.

As illustrated in FIG. 5, the multi-functional peripheral 100 includes the toner containers 7, toner feed units 8, and the intermediate hoppers 9 (corresponding to toner replenishment devices) for each of the colors of toner (black, yellow, cyan, and magenta) in order to replenish a corresponding one of the developing devices 34. Since the toner containers 7, the toner feed units 8, and the intermediate hoppers 9 for the respective colors have similar structures, similar components for each color are denoted by similar reference signs while the signs such as Bk, Y, C and M indicating the colors are omitted for convenience of description.

Each toner container 7 includes a container sensor 71 that is used for detecting that the toner container 7 has run out of toner. Output of each of the container sensors 71 is transmitted to the engine control unit 6. The engine control unit 6 can recognize a particular one of the toner container 7 that has run out of the toner. The engine control unit 6 may recognize that the toner container 7 has run out of the toner when the amount of the toner in the intermediate hopper 9 does not reach a specified amount after the toner has been fed from the toner container 7 to the intermediate hopper 9 for a certain period of time. The details of the intermediate hopper 9 will be described later.

In order to feed the toner from one of the toner containers 7 to a corresponding one of the intermediate hoppers 9, the toner feed unit 8 is provided for each of the intermediate hoppers 9. The toner feed unit 8 includes a replenishment screw 81, a feed motor 82, and so forth. The replenishment screw 81 receives the toner from the toner container 7 and feeds the toner to the intermediate hopper 9. The feed motor 82 rotates the replenishment screw 81. The replenishment screw 81 has, for example, a spiral-shaped blade provided on a rotation shaft, and rotates so as to introduce (feed) the toner into the intermediate hopper 9. In order to feed the toner into the intermediate hopper 9, the engine control unit 6 causes one of the feed motors 82 corresponding to the target intermediate hopper 9 to rotate, thereby rotating the replenishment screw 81.

Each intermediate hopper 9 includes a toner sensor 90 (corresponding to a toner detector, the details will be described later) that is used for detecting whether or not the intermediate hopper 9 is filled with the specified amount of the toner. Each intermediate hopper 9 includes the first agitating paddle 91 (corresponding to an agitating member, the details will be described later) and a second agitating paddle 92 (the details will be described later). The first agitating paddle 91 loosens and agitates the toner having been fed. Each intermediate hopper 9 includes a replenishment screw 93 by which a corresponding one of the developing devices 34 is replenished with the toner in the intermediate hopper 9. The replenishment screw 93 has, for example, a spiral-shaped blade provided on a rotation shaft, and rotates so as to introduce (feed) the toner into the developing device 34.

Each intermediate hopper 9 includes an intermediate hopper motor 94 that rotates the first agitating paddle 91, the second agitating paddle 92, and the replenishment screw 93. The intermediate hopper motor 94 is rotatable in forward and reverse rotation directions. In order to replenish one of the developing devices 34 with the toner, the engine control unit 6 causes one of the intermediate hopper motors 94, which corresponds to the developing device 34 into which the toner should be fed, to rotate, thereby rotating the replenishment screw 93.

Each intermediate hopper 9 includes an encoder 95 (corresponding to a position detector) for recognizing a rotation angle (corresponding to a rotational position) of the first agitating paddle 91. The encoder 95 outputs pulses based on the rotation of the intermediate hopper motor 94. Output of the encoder 95 is input to the engine control unit 6 (counted by, for example, the counter 63). The engine control unit 6 recognizes a rotation angle of each first agitating paddle 91 based on the output of a corresponding one of the encoders 95.

Each developing device 34 includes a developing sensor 38, which is used for detecting that the amount of the toner in the developing device 34 becomes (has decreased to an amount) less than a predetermined amount. The developing sensor 38 uses an optical sensor. Output of the developing sensor 38 is input to the engine control unit 6. When the engine control unit 6 recognizes that the amount of the toner in the developing device 34 becomes less than the predetermined amount based on the output of the developing sensor 38, the engine control unit 6 causes the intermediate hopper 9 to replenish the developing device 34 with the toner. Main motors 39 are provided to rotate components (the photoconductor drums 32 and the rollers in the developing devices 34) of the image forming section 3. The engine control unit 6 causes the main motors 39 to operate in printing.

Next, the specific structure of the illustrative intermediate hopper 9 according to the present embodiment will be described with reference to FIGS. 6 and 7.

As described above, the intermediate hopper 9 is provided between each toner container 7 and a corresponding one of the developing devices 34 in the multi-functional peripheral 100 according to the present embodiment. The developing device 34 is replenished with the toner from the toner container 7 through the intermediate hopper 9. Although usage of the toner is different depending on a target image in printing as is the case with a difference in usage of toner for a solid image and a text image, the intermediate hoppers 9 each store some amount of the toner, for example, with which several hundreds of A4 sheets or so can be printed on average.

When the toner container 7 has run out of the toner, a user replaces the empty toner container 7 with a new toner container 7. Replacement of the toner container 7 takes a certain time. When the user does not have a replacement toner container 7 at hand, a time is taken for the replacement toner container 7 to be delivered. In these cases, a state in which printing cannot be performed may continue until the toner container 7 has been replaced, or the toner container 7 has been arrived. However, when the intermediate hopper 9 is provided, printing can be continued for a certain period of time using the toner in the intermediate hopper 9. Thus, convenience for the user can be improved and productivity of the multi-functional peripheral 100 can be ensured by providing the intermediate hopper 9.

A toner receiving port 96 is provided at an upper end of each of the intermediate hoppers 9. The toner from the corresponding toner container 7 is fed into the intermediate hopper 9 through the toner receiving port 96. The engine control unit 6 causes the feed motors 82 to operate, thereby feeding the toner into the intermediate hoppers 9.

The toner sensor 90 is provided on a side surface of each of the intermediate hoppers 9 such that the toner sensor contacts the toner in the intermediate hopper 9. The toner sensor 90 according to the present embodiment is a piezoelectric sensor that vibrates. When a portion of the toner sensor 90, the portion being exposed to the interior of the intermediate hopper 9, contacts the toner, vibration of the toner sensor 90 is suppressed. Output of the toner sensor 90 changes depending on to what extent a detection surface of the toner sensor 90 is contacted by the toner and vibration of the toner sensor 90 is suppressed.

For example, when the intermediate hopper 9 is filled with the toner to the extent in which the toner sensor 90 contacts the toner up to a level indicated by a two-dot chain line in FIG. 6, the toner sensor 90 outputs high. In contrast, when the amount of the toner in the intermediate hopper 9 decreases to a level lower than the level indicated by the two-dot chain line in FIG. 6 due to replenishment of the toner to the developing device 34, the toner sensor 90 outputs low. When the toner sensor 90 outputs low, the engine control unit 6 recognizes that the intermediate hopper 9 has run out of the toner and causes the toner feed unit 8 to operate so as to feed the toner into the intermediate hopper 9.

A toner delivery port 97 is provided at a lower end of each of the intermediate hoppers 9. The toner delivery port 97 is connected to the developing device 34. The replenishment screw 93 is provided at a portion leading to the toner delivery port 97. The engine control unit 6 causes the intermediate hopper motor 94 to operate so as to rotate the replenishment screw 93, thereby replenishing the developing device 34 with the toner.

The first agitating paddle 91 is provided in each of the intermediate hoppers 9 such that, in some embodiments, a rotation center of the first agitating paddle 91 is at substantially the same level as that of the toner sensor 90. A rotation shaft 91*a* of the first agitating paddle 91 is provided with two agitating blades 10. The two agitating blades 10 are formed of, for example, film-like resin. The two agitating blades 10 are mounted on the rotation shaft 91*a* such that an angle between one of the agitating blades 10 and the other agitating blade 10 is about 180 degrees about the rotation shaft 91*a* (linear shape) as illustrated in FIG. 6.

The agitating blades 10 will be described with reference to FIG. 7. The agitating blades 10 each have a plate-like shape. The agitating blades 10 each have openings formed therein. The openings are spaced apart from one another by a certain distance. When the first agitating paddle 91 rotates, the toner passes through the openings. The toner that contacts part of the first agitating paddle 91 where no openings are formed is moved. Thus, the toner is loosened.

The first agitating paddle 91 may rotate in a direction indicated by solid arrows in FIG. 6 (may also or alternatively be rotatable in a direction opposite to the solid arrow direction depending on a rotation direction of the intermediate hopper motor 94) and agitates and loosens the toner fed from the toner container 7 while moving the toner toward the second agitating paddle 92 and the replenishment screw 93. The length of each of the agitating blades 10 in a direction perpendicular to the axial direction of the first agitating paddle 91 is set such that each of the agitating blades 10 does not contact the toner sensor 90. However, in order to sufficiently agitate the toner in the intermediate hopper 9 in as large an area as possible, the length of each of the agitating blades 10 in a direction perpendicular to the axial direction of the first agitating paddle 91 is set to such a length that, when one of the agitating blades 10 comes closest to the toner sensor 90, the distance (gap) between an end edge of this agitating blade 10 of the first agitating paddle 91 and the toner sensor 90 is typically very small (for example, 1 mm or smaller).

The second agitating paddle 92 is provided at a position on a lateral side of the first agitating paddle 91 and above the replenishment screw 93 in the intermediate hopper 9. The second agitating paddle 92 rotates in a direction indicated by a solid arrow in FIG. 6, thereby moving the toner toward the replenishment screw 93. A flow of toner transportation from the toner receiving port 96 toward the toner delivery port 97 is formed by the first agitating paddle 91 and the second agitating paddle 92.

Figure 8:
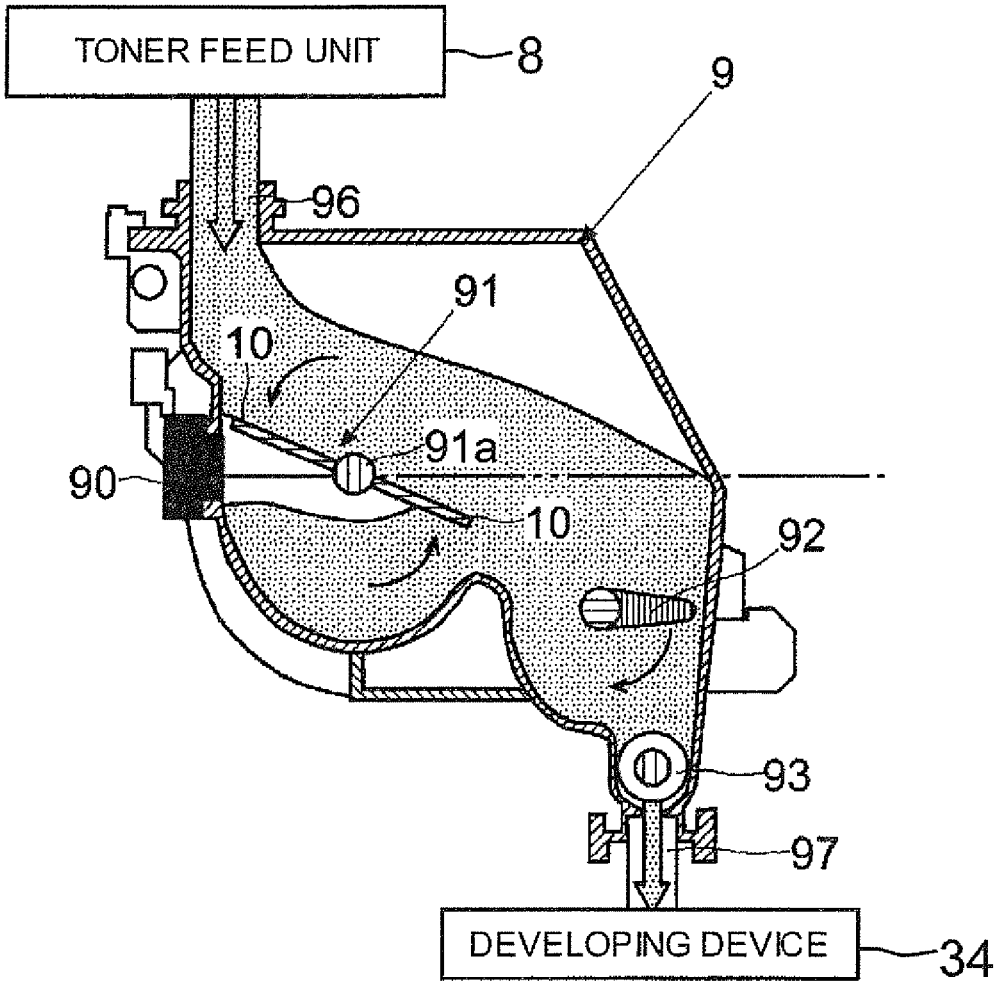
FIG. 8 is an explanatory view illustrating effects, which is produced by the first agitating paddle, on detection performed by a toner sensor when toner is fed into the intermediate hopper according to the first embodiment.
Figure 9:
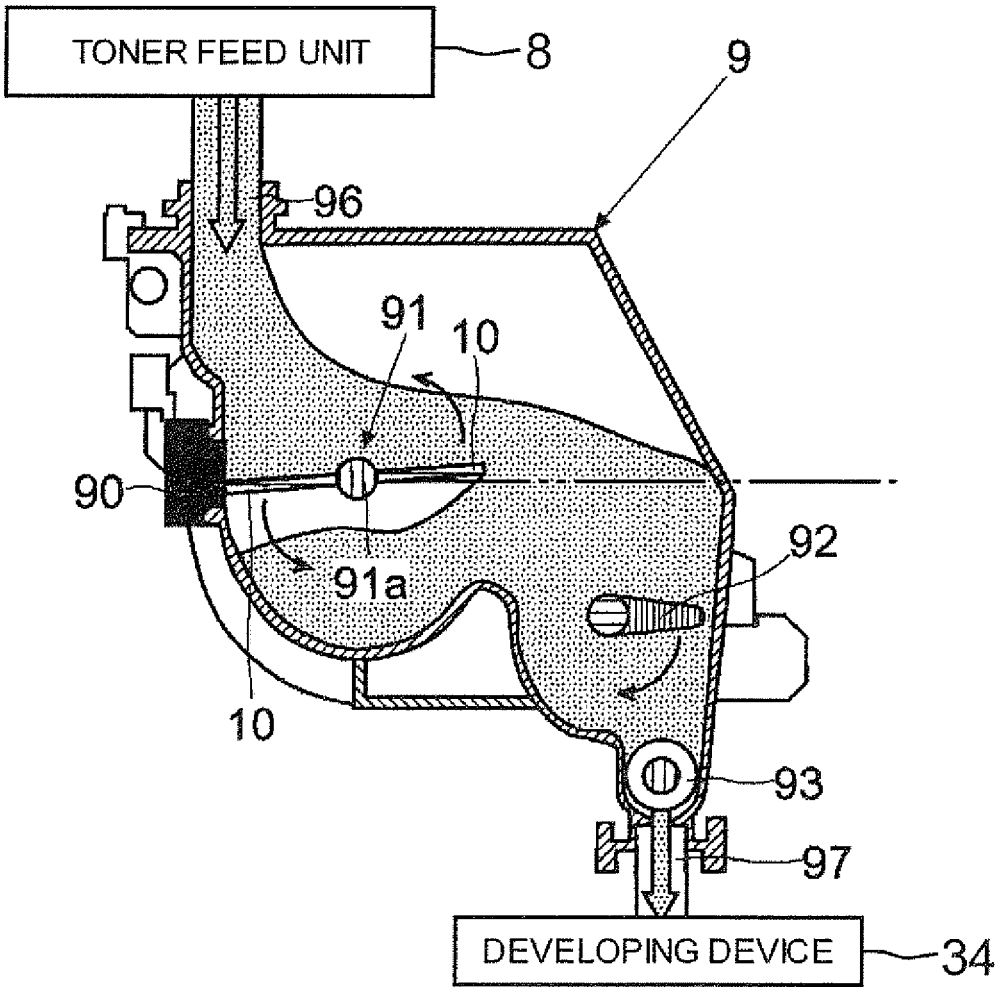
FIG. 9 is an explanatory view illustrating effects, which are produced by the first agitating paddle, on detection performed by the toner sensor when the toner is fed into the intermediate hopper according to the first embodiment.

An illustrative relationship between detection performed by using the toner sensor 90 and the rotation angle of the first agitating paddle 91 according to the first embodiment will now be described with reference to FIGS. 8 and 9. FIGS. 8 and 9 are explanatory views illustrating effects, which may be produced by the first agitating paddle 91, on detection performed by using the toner sensor 90 when the toner is fed into the intermediate hopper 9 according to the first embodiment.

As described above, since the gap between the toner sensor 90 and one of the agitating blades 10 of the first agitating paddle 91 is typically set to a very small distance, when the rotation angle of the first agitating paddle 91 is an angle at which the end edge of one of the agitating blades 10 comes close to an upper end (of the detection surface) of the toner sensor 90 as illustrated in FIG. 8, this one of the agitating blades 10 functions like an umbrella and prevents the toner from reaching the toner sensor 90.

Furthermore, since under such conditions by using the toner sensor 90 the engine control unit 6 cannot detect that the amount of the toner has reached a specified amount in the intermediate hopper 9, the engine control unit 6 causes the feeding of the toner into the intermediate hopper to be continued. But, the toner passes though the openings in the agitating blades 10 little by little and finally reaches the toner sensor 90. So the engine control unit recognizes that the intermediate hopper 9 is filled with toner and causes the toner feed unit 8 to stop. As a result, the intermediate hopper 9 may be filled with a large amount of the toner as illustrated in FIG. 8. The first agitating paddle 91 stops rotating while the toner is fed into the intermediate hopper 9. When the feeding of the toner into the intermediate hopper 9 is stopped and the developing device 34 is being replenished with the toner from the intermediate hopper 9, the first agitating paddle 91 rotates when the developing device 34 is fed with the toner. When the intermediate hopper 9 is filled with a large amount of the toner and the first agitating paddle 91 and the second agitating paddle 92 rotate, part of the toner may be moved above the level of the toner receiving port 96 and overflow. The toner may also overflow while the toner is being fed when the feeding of the toner into the intermediate hopper 9 is further continued from a state illustrated in FIG. 8. The toner having overflowed may contaminate the interior of the multi-functional peripheral 100. Furthermore, the toner having overflowed may adhere to the sheet and contaminate the sheet. Since a variety of components are arranged in the multi-functional peripheral 100, there may be a case in which removing the toner and cleaning the interior of the multi-functional peripheral 100 is difficult.

In addition, the fact that the intermediate hopper 9 has been filled with the specified amount of the toner is not necessarily detectable by using the toner sensor 90 even when, as illustrated in FIG. 9, the end edge of one of the agitating blades 10 has passed the upper end of the toner sensor 90 and is approaching the lower end of the toner sensor 90 and part of the toner contacts the toner sensor 90. When the above-described situation occurs, the toner may also be fed into the intermediate hopper 9 to such an extent as that the toner overflows. Thus, it is preferable that the toner feed unit 8 feeds the toner into the intermediate hopper 9 when the rotation angle of the first agitating paddle 91 is an angle at which neither of the end edges of the agitating blades 10 completely opposes (or comes close to, or otherwise occludes or shields) the detection surface of the toner sensor 90 or otherwise disrupts or adversely impacts the accurate detection of the toner level by using the toner sensor 90.

In order to avoid drawbacks due to the agitating blades 10 preventing the toner from reaching the toner sensor 90, the following measure may be taken. That is, when some amount of the toner has been fed into the intermediate hopper 9, the first agitating paddle 91 is rotated for a certain amount of time, and then output of the toner sensor 90 is checked. However, in some cases it takes about several tens of seconds (for example, about one minute) while the first agitating paddle 91 performs one rotation. Accordingly, in such cases, it takes a long time from a time when the toner is fed to a time when whether or not the intermediate hopper 9 is filled with the specified amount of the toner is checked. To overcome the above-described issue, in the multi-functional peripheral 100 according to the present embodiment, the engine control unit 6 operates as follows. When the position of the end edge of one of the agitating blades 10 is within a specified range, the engine control unit 6 enables the toner feed unit 8 to feed the toner into the intermediate hopper 9. That is, when the end edge of one of the agitating blades 10 is within the specified range θ, neither of the agitating blades 10 prevents the toner to be fed from reaching the toner sensor 90, and the feeding of the toner into the intermediate hopper 9 is permitted as may be needed. Thus, the fact that the intermediate hopper 9 has been filled with the specified amount of the toner is detected in a short time.

Figure 10:
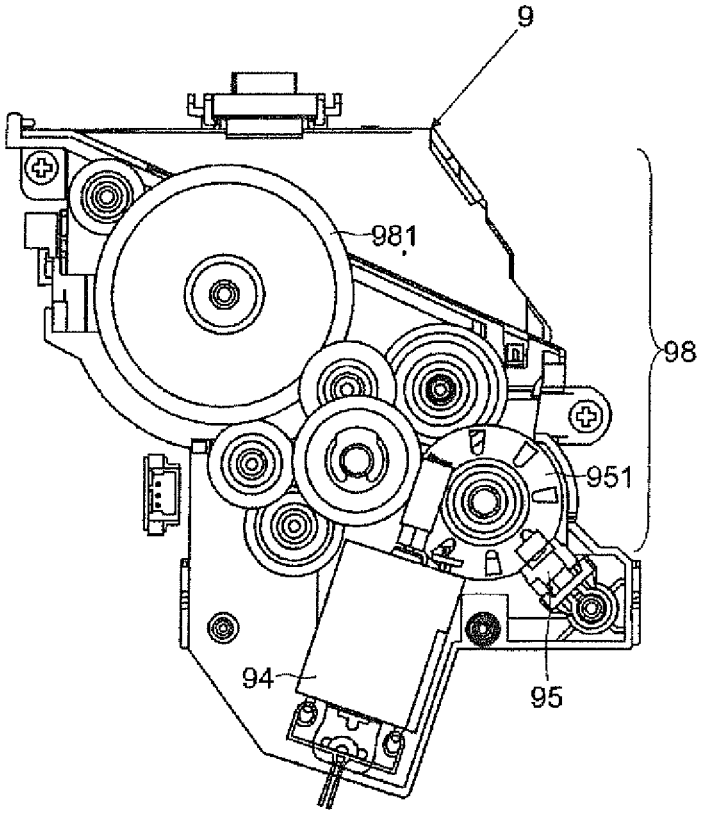
FIG. 10 is a front view of the intermediate hopper according to the first embodiment.

An illustrative example of a method of recognizing the rotation angle of the first agitating paddle 91 in the intermediate hopper 9 according to the first embodiment will be described with reference to FIG. 10. FIG. 10 is a front view of the intermediate hopper 9 according to the first embodiment.

FIG. 10 illustrates the intermediate hopper 9 seen from the front side. The intermediate hopper 9 includes the intermediate hopper motor 94 and a gear train 98 at the front portion thereof. Using a plurality of gears being engaged with one another, a gear 981, which rotates the first agitating paddle 91 and is spaced away from the intermediate hopper motor 94, is rotated. The gear 981 is the largest gear in the gear train 98. The rotation shaft 91*a* of the first agitating paddle 91 is connected to the gear 981. Although gears that rotate the second agitating paddle 92 and the replenishment screw 93 are also provided, these gears are hidden behind the gear train 98 in FIG. 10, and illustration of these gears are omitted.

As illustrated in FIG. 10, a encoder gear 951 for the encoder 95, which is used for detecting and recognizing the rotation angle of the first agitating paddle 91, contacts a rotation shaft of the intermediate hopper motor 94. The encoder gear 951 has openings spaced apart from one another by a certain distance (a certain angle). The encoder 95 includes a light emitter and a light receiver on one side and the other side of the encoder gear 951. The encoder 95 outputs high (or may instead be low) when, for example, light passes through one of the openings and is received by the light receiver, and outputs low (or may instead be high) when the light from the light emitter is interrupted by the encoder gear 951. Thus, the encoder 95 outputs a pulse-like signal every time the encoder gear 951 rotates through a certain angle.

Output of the encoder 95 is input to the engine control unit 6 (see FIG. 5). Ratios between the gears in the gear train 98 are set such that the first agitating paddle 91 performs one rotation while the encoder 95 outputs a specified number of pulse-like signals. When the first agitating paddle 91 performs one rotation while the encoder 95 outputs, for example, 100 pulse-like signals, the first agitating paddle 91 rotates through 3.6 degrees per pulse.

Furthermore, in the multi-functional peripheral 100 according to the present embodiment, a reference position (initial position) of the first agitating paddle 91 is set. Since the agitating blades 10 are secured to the first agitating paddle 91, the reference position is set also based on the position of the end edge of one of the agitating blades 10. The reference position is set, for example, when the multi-functional peripheral 100 is shipped from the factory. The reference position of the first agitating paddle 91 is set at a position, for example, where one of the agitating blades 10 overlaps (comes closest to) the upper or lower end of the toner sensor 90. Thus, the reference position for the end edge of one of the agitating blades 10 is set. The engine control unit 6 recognizes a present angle of the first agitating paddle 91 relative to the reference position based on the number of pulses counted from the reference position. Thus, the engine control unit 6 can recognize where the position of the end edge of one of the agitating blades 10 is relative to the reference position.

As indicated, in some embodiments the encoder 95 outputs, for example, 100 pulses while the first agitating paddle 91 performs one rotation. The engine CPU 61 of the engine control unit 6 causes the intermediate hopper motor 94 to drive while counting the pulses output from the encoder 95 and causing the memory 62 or the storage device 53 to store the counted value.

At this time, in some implementations, the engine control unit 6 may reset the counted number every time the pulse count reaches 100 (resets every time the counted number of pulses reaches the number of pulses per rotation of the first agitating paddle 91), and repeat counting pulses from the encoder 95 in a range of 1 to 100 while causing the memory 62 or the storage device 53 to store the count value from 1 to 100. When the main power of the multi-functional peripheral 100 is turned off, the count value is stored in a non-volatile area of the memory 62 or the storage device 53. In this case, the engine control unit 6 can recognize how far the first agitating paddle 91 has rotated from the reference position (where the position of one of the agitating blades 10 is) by multiplying the angle per pulse by the count value.

Alternatively, the memory 62 or the storage device 53 may store a count value of the accumulated number of pulses from the first pulse. In this case, the engine control unit 6 divides the count value of the accumulated number of the pulses by the number of pulses per rotation of the first agitating paddle 91 and obtains the remainder. Then, the engine control unit 6 can recognize how far the first agitating paddle 91 has rotated from the reference position (where the position of one of the agitating blades 10 is) by multiplying the angle per pulse by the remainder. Also in this case, when the main power of the multi-functional peripheral 100 is turned off, the count value of the accumulated number of pulses is stored in a non-volatile area of the memory 62 or the storage device 53.

In order to provide a reference for the engine control unit 6 to ascertain, when needed, how far the first agitating paddle 91 has rotated from the reference position (how far one of the agitating blades 10 rotates forward from the reference position), data indicative of the predetermined reference position of the first agitating paddle 91 (agitating blades 10) and the number of pulses output from the encoder 95 while the first agitating paddle 91 performs one rotation is stored in the memory 62 or the storage device 53.

By doing this, the engine control unit 6 can always ascertain a present rotation angle of the first agitating paddle 91 and the position of the end edge of one of the agitating blades 10 based on the count value of pulses and a predetermined rotation angle of the first agitating paddle 91 per pulse. As indicated, in some implementations the first agitating paddle 91 may be controlled to additionally rotate in the reverse rotation direction. In this case, the engine control unit 6 decreases the count value of pulses.

Figure 11:
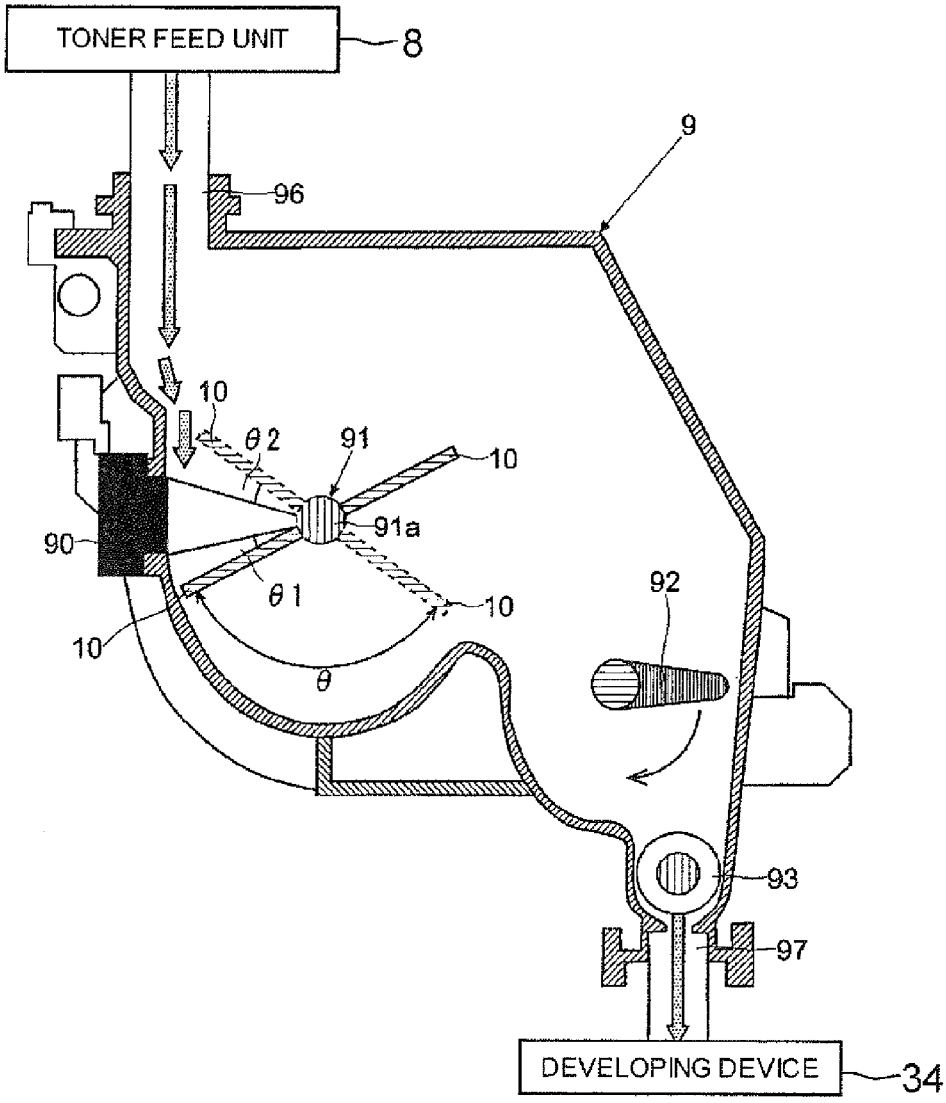
FIG. 11 is an explanatory view illustrating timing at which the toner is fed into the intermediate hopper according to the first embodiment.

An example of the timing for feeding toner into the intermediate hopper 9 according to some implementations of the first embodiment will now be described with reference to FIG. 11. FIG. 11 is an explanatory view for describing timing at which the toner is fed into the intermediate hopper 9 according to the first embodiment.

The toner is fed into the intermediate hopper 9 according to some implementations of the present embodiment when the rotation angle of the first agitating paddle 91 is in a specified range θ based on the rotation angle of the first agitating paddle 91 recognized by the engine control unit 6. When the rotation angle of the first agitating paddle 91 is in the specified range θ, neither of the end edges of the agitating blades 10 blocks the flow path of the toner (a path along which the toner flows down) from the toner receiving port 96 to the toner sensor 90.

For example, as illustrated in FIG. 11, the specified range θ is determined within a range defined between positions of the end edge of one of the agitating blades 10 of the first agitating paddle 91 as follows: a position at which the end edge of the one of the agitating blades 10 passed the level of the lower end (of the detection surface) of the toner sensor 90, and the other position at which the end edge of the other agitating blade 10 is approaching a position at which the other end edge of the agitating blades 10 comes closest to the upper end of the toner sensor 90 (that is a range in which neither of the agitating blades 10 completely opposes the toner sensor 90). It will be understood, however, that in various implementations, the specified range θ may be narrower or larger than such a range (e.g., depending on the particular configuration of the hopper, etc.), provided that the toner sensor 90 can reliably detect the toner level when toner is being fed into the intermediate hopper 9 and the agitating blade 10 is positioned at either of the limits of θ.

By way of example, in order to ensure a sufficient gap between each of the end edges of the agitating blades 10 and the toner sensor 90, the specified range θ of the agitating blades 10 may be determined in a range defined, for example, between the following two positions of the end edge of one of the agitating blades 10: a position that is spaced away from a position at which the end edge of the one of the agitating blades 10 comes closest to the lower end (of the detection surface) of the toner sensor 90 by a predetermined angle (a first specified angle θ1, for example, about 5 to 30 degrees) in a direction away from the lower end of the toner sensor 90, and the other position at which the end edge of the other agitating blade 10 is at a position that is spaced away from a position at which the end edge of the other agitating blade 10 comes closest to the upper end (of the detection surface) of the toner sensor 90 by a predetermined angle (a second specified angle θ2, for example, about 5 to 30 degrees) in a direction away from the upper end of the toner sensor 90. The first specified angle θ1 may be as same as the second specified angle θ2.

As described above, the specified range θ may be determined in a range of the rotation angle of the first agitating paddle 91 from a rotation angle of the agitating paddle 91 at which the end edge of one of the agitating blades 10 is at the level of the lower end (of the detection surface) of the toner sensor 90 to a rotation angle of the agitating paddle 91 at which the end edge of the other agitating blade 10 comes closest to the upper end of the toner sensor 90. The specified range θ may be desirably determined in the above-described range as long as the gap between each of the end edges of the agitating blades 10 and the toner sensor 90 is sufficiently ensured. For example, a specified range θ of the agitating blades 10 may be determined in a range from a position at which the end edge of one of the agitating blades 10 rotated through relative to the lower end (of the detection surface) of the toner sensor 90 by about five degrees to a position at which the agitating blades 10 assume a vertical position.

FIG. 11 illustrates the specified range θ in accordance with some embodiments. The specified range θ is, for example, about 120 to 140 degrees in terms of the rotation angle of the first agitating paddle 91 according to the present embodiment. When the first agitating paddle 91 is made to have a single agitating blade 10, the specified range θ may be set about 240 to 280 degrees in terms of the rotation angle of the first agitating paddle 91.

In order to input the toner into the intermediate hopper 9, the engine control unit 6 causes the intermediate hopper motor 94 to stop and the toner feed unit 8 to feed the toner when the rotation angle of the agitating blades 10 is within the specified range θ. Presently, when the rotation angle of the agitating blades 10 is within the specified range θ, the agitating blades 10 do not need to be rotated. It is assumed that, as described above, one rotation of the first agitating paddle 91 takes one minute and the specified range θ is about 120 to 140 degrees in terms of the rotation angle of the first agitating paddle 91. In this case, even when the intermediate hopper motor 94 is being driven, the toner can be fed continuously for about 20 seconds. This period of time is sufficient to fill the intermediate hopper 9 with the specified amount of the toner. When the toner sensor 90 cannot detect that the intermediate hopper 9 has been filled with the specified amount of the toner after the toner has been fed into the intermediate hopper 9 continuously for about 20 seconds, it is sufficient that the engine control unit 6 causes the toner feed unit 8 to again feed the toner when the rotation angle of the agitating blades 10 becomes an angle within the specified range θ. Thus, the intermediate hopper motor 94 may be driven while feeding the toner into the intermediate hopper 9.

Data relating to the specified range θ is stored in the memory 62 or the storage device 53. Specifically, as data indicative of the specified range θ, for example, a range of the numbers of pulses from the reference position (for example, such a range of pulses as from 10th pulse to 40th pulse from a pulse indicative of the reference position) may be determined.

As described above, the toner is fed into the intermediate hopper 9 at a timing at which neither of the agitating blades 10 blocks the path from the toner receiving port 96 to the toner sensor 90. Thus, neither of the agitating blades 10 covers the toner sensor 90 and detection performed by using the toner sensor 90 is not interfered with by the agitating blades 10. Accordingly, the engine control unit 6 can immediately detect the toner having been fed by using the toner sensor 90.

Figure 12:
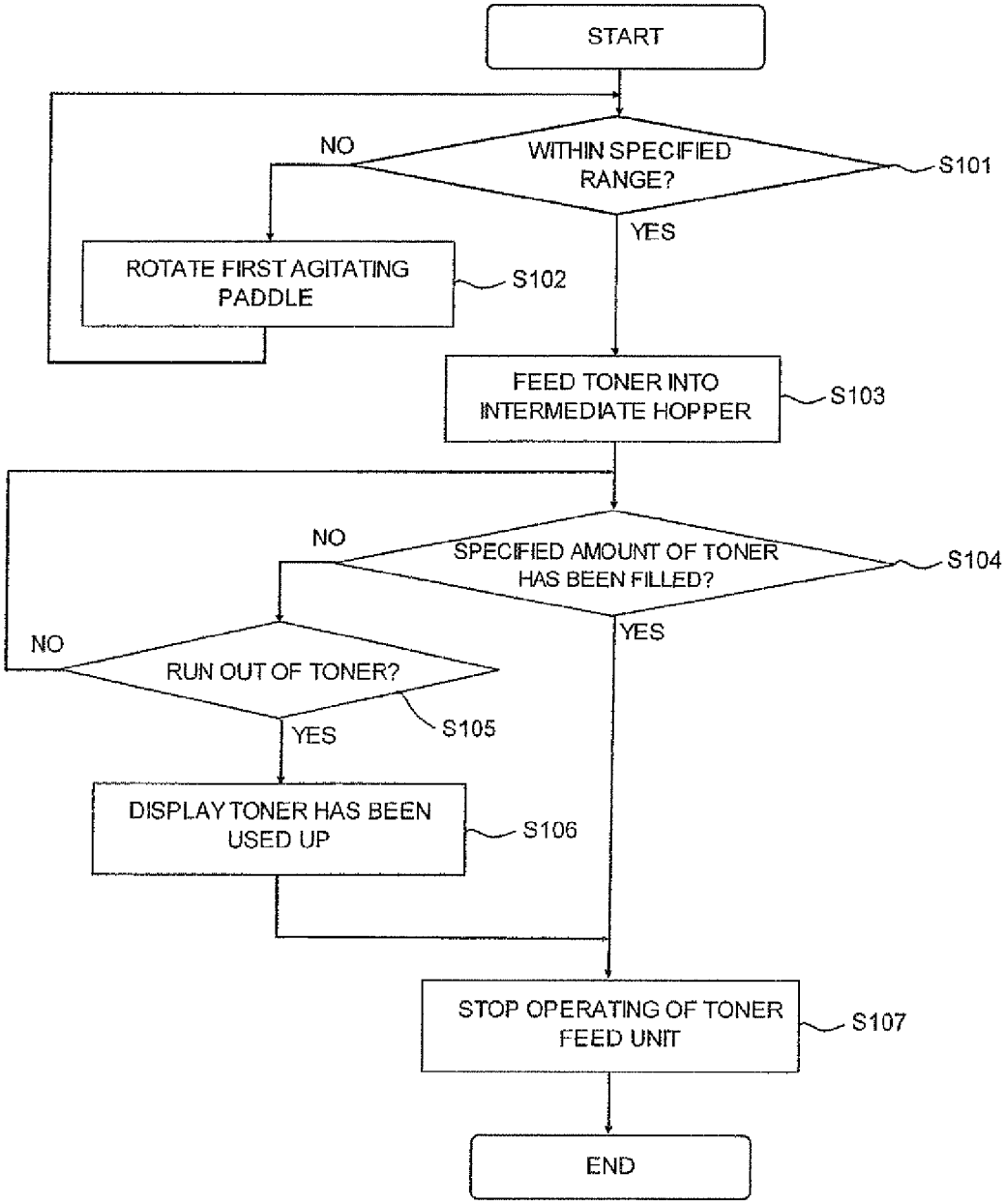
FIG. 12 is an explanatory view illustrating a flow of an operation of feeding the toner into the intermediate hopper according to the first embodiment.

An operational flow of an operation of feeding the toner into the intermediate hopper 9 according to some implementations of the first embodiment will be described with reference to FIG. 12. FIG. 12 is an explanatory diagram illustrating a flow of the operation of the feeding the toner into the intermediate hopper 9 according to the first embodiment.

In FIG. 12, START indicates a timing at which the engine control unit 6 causes the operation of the feeding of the toner to start when the engine control unit 6 recognizes that the intermediate hopper 9 has run out of the toner based on the output from the toner sensor 90. The output indicates that there is no toner or little toner left (for example, low) in the intermediate hopper 9. The output is continuously output from the toner sensor 90 for a specified period of time. In other words, at this timing, the engine control unit 6 recognizes that the toner needs to be fed into the intermediate hopper 9 and causes the toner feed unit 8 to operate so as to enable (e.g. permit) the feeding of the toner into the intermediate hopper 9. The timing may instead be a timing at which a particular one of the toner containers 7 is replaced after it has been detected that the toner container 7 has run out of the toner.

The engine control unit 6 initially recognizes the position of the end edge of one of the agitating blades 10 based on the rotation angle of the first agitating paddle 91, and checks whether or not the position of this agitating blade 10 is within the predetermined specified range θ (block S101). When the position of the agitating blade 10 are out of the specified range θ (NO in block S101), the engine control unit 6 causes the intermediate hopper motor 94 to rotate so as to rotate the first agitating paddle 91 (block S102). A clutch (not shown) that transmits rotational drive force only in one of rotation directions is disposed in the drive transmission path between the intermediate hopper motor 94 and the replenishment screw 93. The second agitating paddle 92 receives the drive force through the replenishment screw 93. The clutch is engaged when the replenishment screw 93 and the second agitating paddle 92 rotates clockwise, and is disengaged when the replenishment screw 93 and the second agitating paddle 92 rotates counterclockwise. Thus, in order to replenish the developing device 34 with the toner, the engine control unit 6 causes the intermediate hopper motor 94 to rotate in a direction, by which the replenishment screw 93 and the second agitating paddle 92 rotate clockwise (along with this rotation, the first agitating paddle 91 also rotates). In order not to replenish the developing device 34 with the toner (not to rotate the replenishment screw 93 and the second agitating paddle 92) and to rotate the first agitating paddle 91, the engine control unit 6 causes the intermediate hopper motor 94 to rotate in a direction, by which the replenishment screw 93 and the second agitating paddle 92 rotate counterclockwise (the first agitating paddle 91 also rotates in the opposite direction (clockwise)). In block S102, the engine control unit 6 does not cause the replenishment screw 93 and the second agitating paddle 92 to rotate, and causes the first agitating paddle 91 to rotate. Thus, a situation in which the developing device 34 is replenished with an excessive amount of the toner does not occur. Then, the process returns to block S101.

By doing this, the rotation angle of the first agitating paddle 91 is continuously checked until the position of one of the agitating blades 10 is detected within the predetermined specified range θ.

When the position of one of the agitating blades 10 is within the specified range θ (YES in block S101), the engine control unit 6 causes the toner feed unit 8 to operate so as to feed the toner into the intermediate hopper 9 (block S103). While the toner is being fed into the intermediate hopper 9, rotation of the first agitating paddle 91 is stopped (the engine control unit 6 causes the intermediate hopper motor 94 to stop). The engine control unit 6 checks output of the toner sensor 90 so as to check whether or not the intermediate hopper 9 has been filled with the specified amount of the toner (block S104).

When the intermediate hopper 9 has not been filled with the specified amount of the toner (NO in block S104), the engine control unit 6 checks whether or not a state in which the toner container 7 has been run out of the toner is detected (block S105). When a state in which the toner container 7 has been run out of the toner is not detected (NO in block S105), the flow returns to block S104. When a state in which the toner container 7 has been run out of the toner is detected (YES in block S105), the engine control unit 6 causes the liquid crystal display unit 11 of the operation panel 1*a* to display that the toner has been used up (block S106). Then, the engine control unit 6 causes the toner feed unit 8 to stop operating (block S107). When block S107 is performed, the flow finishes (END).

In block S104, when by using the toner sensor 90 the engine control unit 6 can detect that the intermediate hopper 9 is filled with the specified amount of the toner (YES in block S104), the engine control unit 6 causes the toner feed unit 8 to stop operating (block S107 to END).

Thus, the intermediate hopper 9 (toner replenishment device) according to the present embodiment includes the toner receiving port 96 through which toner is fed into the toner replenishment device, the toner feed unit 8 that feeds the toner into the toner replenishment device through the toner receiving port 96, and the toner detector (toner sensor 90) that contacts the toner in the toner replenishment device and is used for detecting that the toner replenishment device is filled with a specified amount of the toner. The intermediate hopper 9 also includes the agitating member (first agitating paddle 91) that is provided at a position opposite the toner detector, has the agitating blades 10, and rotates so as to agitate the toner in the toner replenishment device, the position detector (encoder 95) that is used for detecting a rotation angle of the agitating member, and the recognition unit (engine control unit 6) that recognizes the rotation angle of the agitating member based on the output of the position detector. In the intermediate hopper 9, the toner feed unit 8 feeds the toner into the intermediate hopper 9 when the position of the end edge of one of the agitating blades 10 is within a specified range θ based on the recognition performed by the recognition unit. When the end edge of one of the agitating blades 10 is in the specified range θ, neither of the agitating blades 10 blocks a flow path of the toner from the toner receiving port 96 to the toner detector.

By doing this, the toner having been fed reaches the toner detector (toner sensor 90) without being interfered with the agitating member (the first agitating paddle 91). Thus, the agitating members do not interfere with detection performed by the toner detector and the toner having been fed reaches the toner detector. The recognition unit (engine control unit 6) can quickly and correctly detect that the toner has been sufficiently fed such that the amount of the toner reaches the specified amount by using the toner detector. Furthermore, since a state in which the toner has been sufficiently fed in such an amount that the amount of the toner reaches the specified amount can be quickly and correctly detected, a situation in which the toner is continuously fed into the toner replenishment device (for example, the intermediate hopper 9) in such an amount that the toner overflows can be avoided.

The specified range θ is, in some embodiments, set to a range between the following two positions of the end edge of one of the agitating blades 10: a position that is spaced away from a position at which the end edge of the one of the agitating blades 10 comes closest to the lower end of the toner detector (toner sensor 90) by the first specified angle θ1 in a direction away from the lower end of the toner detector, and the other position at which the end edge of the other agitating blade 10 is at a position that is spaced away from a position at which the end edge of the other agitating blade 10 comes closest to the upper end of the toner detector by the second specified angle θ2 in a direction away from the upper end of the toner detector. Thus, the toner is fed into the intermediate hopper 9 (toner replenishment device) while a gap between the agitating member (first agitating paddle 91) and the toner detector is reliably formed. The toner can be fed in a state in which none of the agitating members is present at a position above the toner detector so as to overlap the toner detector (a state in which none of the agitating members is at a position where the agitating members cover the toner detector like an umbrella). Accordingly, the toner being fed can reliably reach the toner detector.

The toner replenishment device (the intermediate hopper 9) includes the storage unit (corresponding to the memory 62 or the storage device 53) that stores data. In the toner replenishment device, the position detector is the encoder 95. In the toner replenishment device, the recognition unit (engine control unit 6) recognizes the present rotation angle of the agitating member based on the predetermined reference position of the agitating member (first agitating paddle 91), and data stored in the storage unit and indicative of the number of pulses output from the encoder 95 during one rotation of the agitating member and the number of pulses output from the encoder 95 from the reference position. The storage unit stores the number of pulses output from the encoder 95 in a non-volatile manner. Thus, regardless of whether the main power is turned on or off, the recognition unit can always correctly recognize the rotation angle of the agitating member. With the angle of the agitating member being correctly recognized, the toner can be reliably fed into the intermediate hopper 9 while neither of the agitating blades 10 of the agitating member overlaps the toner detector.

An image forming apparatus (for example, the multi-functional peripheral 100) includes the toner replenishment devices (the intermediate hoppers 9) according to the present embodiment. Thus, the toner is not fed into the toner replenishment devices in such an amount that the toner overflows. Accordingly, the image forming apparatus, the interior of which is free from contamination due to the toner overflowing out of the toner replenishment devices (the intermediate hoppers 9), can be provided.

The image forming apparatus (the multi-functional peripheral 100) also includes toner containing bodies (toner containers 7) that contain the toner and the developing devices 34 that develop electrostatic latent images on image bearing members (photoconductor drums 32). The toner replenishment devices are the intermediate hoppers 9, which each receive the toner from a corresponding one of the toner containing bodies and deliver the toner to a corresponding one of the developing device 34. Thus, the developing devices 34 can be replenished with the toner, which has been sufficiently loosened. When the toner containing bodies have run out of the toner, printing can be continued for a certain period of time using the toner in the corresponding toner replenishment devices, thereby providing the image forming apparatus that is very convenient for the user.

Figure 13:
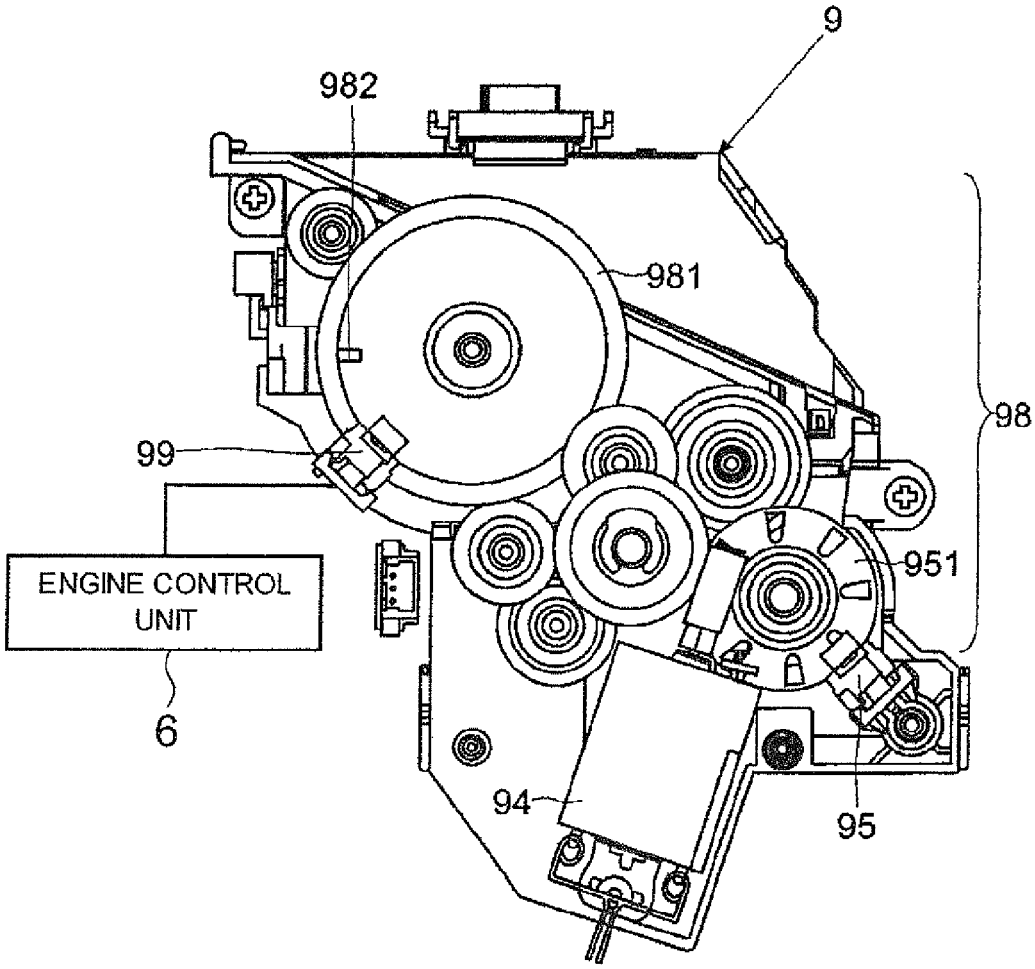
FIG. 13 is a front view of an intermediate hopper according to a second embodiment.
Figure 14:
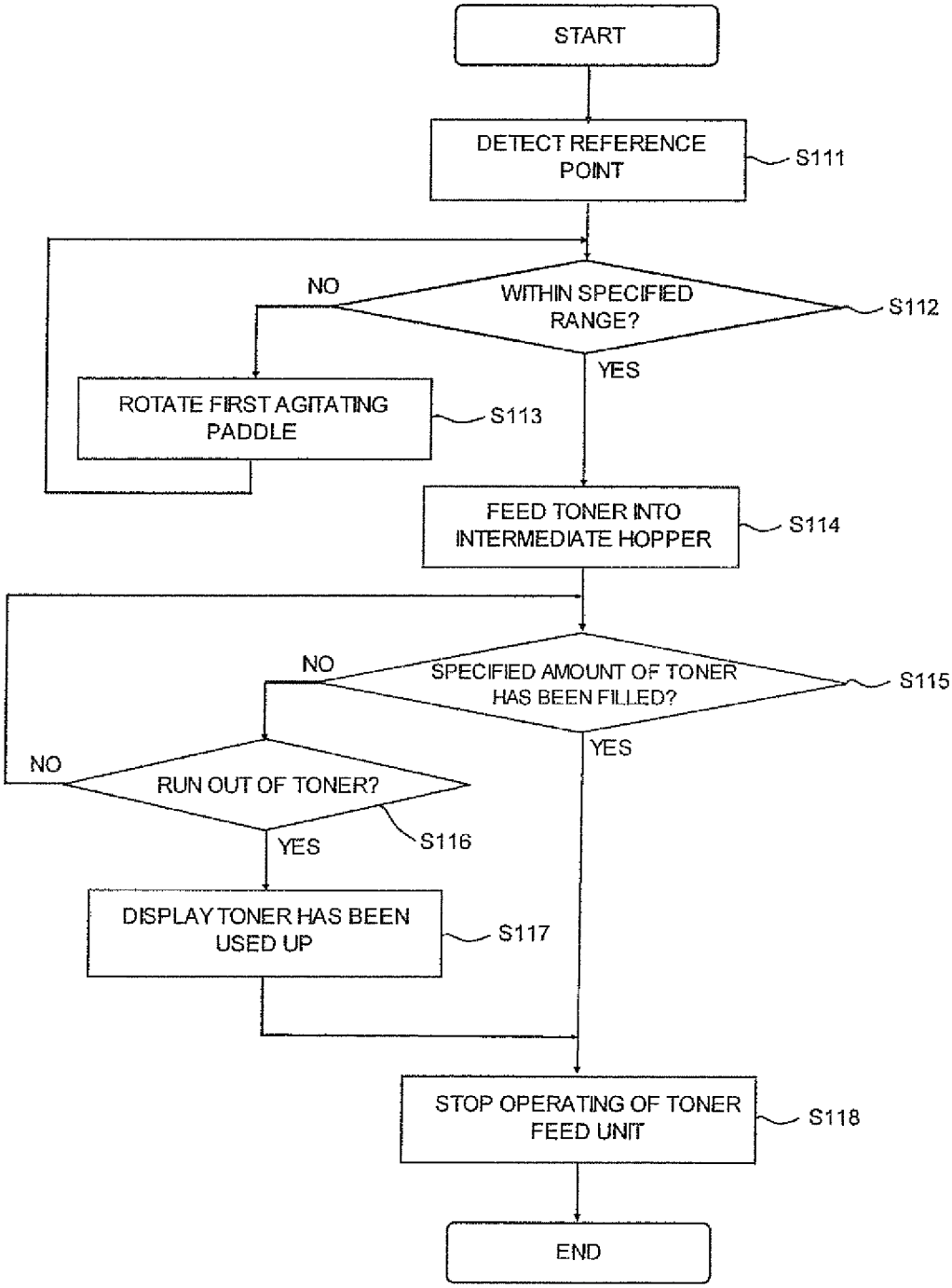
FIG. 14 is an explanatory view illustrating a flow of an operation of feeding the toner into the intermediate hopper according to the second embodiment.

Adjustment of toner feeding timing in an image forming apparatus (multi-function peripheral 100) according to a second illustrative embodiment will now be described with reference to FIGS. 13 and 14. FIG. 13 is a front view of the intermediate hopper 9 according to the second embodiment. FIG. 14 is an explanatory diagram illustrating a flow of an operation of feeding the toner into the intermediate hopper 9 according to the second embodiment.

In the first embodiment, as per the implementation described above, the reference position (initial position) is set and the start pulse among the pulses output from the encoder 95 is associated with the reference position of the first agitating paddle 91 (one of the agitating blades 10). The rotational position (e.g., rotation angle) of the first agitating paddle 91 relative to the reference position is obtained based on the number of pulses output from the encoder 95. The number of pulses is stored in a non-volatile manner. Thus, the rotation angle of the first agitating paddle 91 and the position of the end edge of one of the agitating blades 10 are always recognized. The second illustrative embodiment is different from the first embodiment in that, in the second embodiment, a reference point (opening 982) that indicates the reference position is formed in the gear 981, which rotates the first agitating paddle 91, and the position (e.g., rotation angle) of the first agitating paddle 91 is determined by detection of passage of the reference point.

Except for the above-described differences, it is sufficient for various implementations that the second embodiment be similar to the first embodiment in the following and other points: the configuration of the multi-functional peripheral 100, the structure relating to toner replenishment, the engine control unit 6 being unable to correctly detect the toner by using toner sensor 90 when one of the agitating blades 10 blocks the path through which the toner reaches the toner sensor 90, and the feeding of the toner being performed when one of the agitating blades 10 is within the predetermined specified range θ. Accordingly, the description in the first embodiment is also applicable to features common to the first and second embodiments, and for clarity of exposition the description and illustration of the common features will be omitted unless particularly described.

An example of recognition of the rotation angle of the first agitating paddle 91 in the intermediate hopper 9 according to the second embodiment will be initially described with reference to FIG. 13.

Similar to FIG. 10, FIG. 13 is a diagram of the intermediate hopper 9 seen from the front side. The intermediate hopper 9 is substantially the same as that of the first embodiment. However, the gear 981 that rotates the first agitating paddle 91 according to the present embodiment has the opening 982 therein as the reference point that indicates the reference position. A reference position detection sensor 99 is provided for the gear 981. The reference position detection sensor 99 is a transmissive optical sensor including a light emitter and a light receiver disposed on one side and the other side of the gear 981. The opening 982 of the gear 981 passes through a gap between the light emitter and the light receiver of the reference position detection sensor 99. Thus, output of the reference position detection sensor 99 is different between a situation in which the opening 982 of the gear 981 is within a detection area of the reference position detection sensor 99 and a situation in which the opening 982 of the gear 981 is out of the detection area of the reference position detection sensor 99.

The first agitating paddle 91 is mounted to the gear 981 at a predetermined angle relative to the opening 982 of the gear 981. The first agitating paddle 91 is mounted to the gear 981 such that, when the opening 982 of the gear 981 is detected by using the reference position detection sensor 99, the end of one of the agitating blades 10 comes closest to the toner sensor 90. In this case, the position of the opening 982 indicates the reference position of the end edge of one of the agitating blades 10.

Output of the reference position detection sensor 99 is input to the engine control unit 6. By doing this, the engine control unit 6 obtains a signal indicative of a reference in rotation of the first agitating paddle 91 (gear 981). In other words, the engine control unit 6 obtains a signal as a start point for recognizing a position at which the end edge of one of the first agitating paddle 91 presently is.

In the multi-functional peripheral 100 according to the present embodiment, the first agitating paddle 91 is mounted to the gear 981 at a predetermined angle in accordance with the reference point (opening 982). Since the agitating blades 10 are secured to the first agitating paddle 91, the reference position for the position of the end edge of one of the agitating blades 10 is set based on the reference point. A present angle of the first agitating paddle 91 relative to the reference position is recognized based on the number of pulses counted from the reference position. Thus, the engine control unit 6 can recognize where the position of the end edge of one of the agitating blades 10 is relative to the reference position.

It is assumed that the encoder 95 outputs 100 pulses while the first agitating paddle 91 performs one rotation. The engine CPU 61 of the engine control unit 6 counts pulses output from the encoder 95 after the reference position detection sensor 99 has detected the reference point (opening 982) while causing the intermediate hopper motor 94 to drive.

In this case, the engine control unit 6 can recognize how far the first agitating paddle 91 has rotated from the reference position (where the position of one of the agitating blades 10 is) by multiplying the angle per pulse by a count value counted from a time when the reference position detection sensor 99 detects the reference point (opening 982). The first agitating paddle 91 may rotate in the reverse rotation direction. When the first agitating paddle 91 rotates in the reverse rotation direction, the engine control unit 6 decreases the count value of pulses.

In order for the engine control unit 6 to refer to when recognizing how far the first agitating paddle 91 has rotated from the reference position (how far one of the agitating blades 10 is moved forward from the reference position), data indicative of the number of pulses output from the encoder 95 while the first agitating paddle 91 performs one rotation is stored in the memory 62 or the storage device 53 (or, similarly, data indicative of a rotation angle of the first agitating paddle 91 per pulse may be stored).

The memory 62 or the storage device 53 stores data indicating that, out of the rotation angles of the first agitating paddle 91, what range of angles correspond to the specified range θ when the opening of the gear 981 is set to the start point. For example, the data stored may indicate that, when detection of the reference point (opening 982) performed by using the reference position detection sensor 99 is set to the start point, in what range of pulses among pulses output from the encoder 95 indicate that the end edge of one of the agitating blades 10 of the first agitating paddle 91 is within the specified range θ.

Based on the data in the memory 62 or the storage device 53, the engine control unit 6 recognizes whether or not the rotation angle of the first agitating paddle 91 is within the specified range θ. When the rotation angle relative to the reference position of the end edge of one of the agitating blades 10 is within the predetermined specified range θ, the engine control unit 6 causes the toner feed unit 8 to operate so as to feed the toner into the intermediate hopper 9.

Next, a flow of the feeding the toner into the intermediate hopper 9 according to some implementations of the second embodiment will be described with reference to FIG. 14. FIG. 14 is an explanatory diagram illustrating an operational flow of the feeding the toner into the intermediate hopper 9 according to the second embodiment.

As is the case with the first embodiment, START in FIG. 14 indicates a timing at which the engine control unit 6 causes the toner feeding operation to start when the engine control unit 6 recognizes that the intermediate hopper 9 has run out of the toner based on the output from the toner sensor 90. The output indicates that there is no toner or little toner left (for example, low) in the intermediate hopper 9. The output is continuously output from the toner sensor 90 for a specified period of time. The timing may instead be a timing at which a particular one of the toner containers 7 is replaced after it has been detected that the toner container 7 has run out of the toner.

In the present illustrative embodiment, the engine control unit 6 initially causes the intermediate hopper motor 94 to operate, and detects the reference point (opening 982) using the reference position detection sensor 99 (block S111). When the reference position is detected, the engine control unit 6 checks whether or not the position of the end edge of one of the agitating blades 10 is presently within the specified range θ based on the number of pulses from the encoder 95 (block S112). When the position of the end edge of one of the agitating blades 10 is out of the specified range θ (NO in block S112), the engine control unit 6 causes the intermediate hopper motor 94 so as to rotate the first agitating paddle 91 (block S113) as is the case with the first embodiment. Then, the process returns to block 5112. By doing this, the rotation angle of the first agitating paddle 91 is continuously checked until the position of the end edge of one of the agitating blades 10 is detected within the predetermined specified range θ.

Before this flow is started (before the toner feeding operation is started), the engine control unit 6 may check the output from the reference position detection sensor 99 (may perform the process in block S111 in advance) and check the number of pulses output from the encoder 95 at desired timing so as to recognize the rotation angle of the first agitating paddle 91 relative to the reference position. In this case, block S111 may be skipped.

After that, block S114 to block S118 in the flow are performed similarly to block S103 to block S107 in the first embodiment having been described with reference to FIG. 12. Since the description in the first embodiment is also applicable to block S114 to block S118, the description of block S114 to block S118 is omitted.

Thus, in the intermediate hopper 9 (toner replenishment device) according to the present embodiment, a reference position detector (the reference position detection sensor 99) is a sensor that is used for detecting passage of the reference point formed in the gear that rotates the agitating member (first agitating paddle 91), and the recognition unit (engine control unit 6) recognizes the rotation angle of the agitating member (first agitating paddle 91) based on the amount of rotation after the recognition unit has detected the reference point. By utilizing the structure in which the positions of the agitating blades 10 relative to the reference point are fixed, the rotation angle of the agitating member (first agitating paddle 91) can be correctly recognized and the toner can be fed while neither of the agitating blades 10 overlaps the toner detector (toner sensor 90).

By way of example, some illustrative variations or modifications according to some embodiments will now be described. In the above-described embodiments, examples in which the engine control unit 6 functions as the recognition unit have been described. The recognition unit recognizes the rotation angle of the first agitating paddle 91, thereby recognizing the position of the end edge of one of the agitating blades 10. Instead, for example, output of a variety of detectors may be input to a unit other than the engine control unit 6, and the unit other than the engine control unit 6 may be made to function as a recognition unit (for example, the main control unit 5, a dedicated circuit, a chip, or the like).

Although an example of the toner sensor 90 uses a piezoelectric sensor in the above-described embodiments, the toner sensor 90 is not limited to a piezoelectric sensor (for example, a reflective optical sensor) as long as the toner can be detected. Although the encoder 95 using an optical sensor is described as an example of the position detector, the position detector is not limited to the above-described encoder 95 as long as the rotation angle of the first agitating paddle 91 can be detected by the sensor. In addition, those skilled in the art will understand that for any given type of encoder or sensor (e.g., even using an optical sensor), there are many configurations that may be employed to provide a signal indicative of the position of the agitating paddle. For example, in some implementations, an optical sensor/encoder may be configured to provide a binary signal indicative of whether or not the agitating paddle is in a position where it may interfere with accurate or reliable sensing of the toner level.

Having thus described in detail embodiments of the present disclosure, it is to be understood that the subject matter disclosed by the foregoing paragraphs is not to be limited to particular details and/or embodiments set forth in the above description. For example, particular numerical values or ranges are provided by way of illustration for clarity of exposition, and are not intended to limit the possible values or ranges that may be implemented in accordance with the present disclosure. Additionally, the present disclosure may be practiced without necessarily providing one or more of the advantages described herein or otherwise understood in view of the disclosure and/or that may be realized in some embodiments thereof. Accordingly, it is understood that many modifications and variations of the embodiments and subject matter disclosed herein are possible without departing from the scope of the present disclosure.

What is claimed is:

1. A toner replenishment device for coupling to a toner containing body comprising:

a toner receiving port through which toner is selectively fed into the toner replenishment device;

a toner feed unit configured to feed the toner from the toner receiving port into the toner replenishment device;

a toner detector configured to be used for detecting, by interaction with the toner, whether the toner replenishment device has been filled with a specified amount of the toner;

an agitating member having an agitating blade, the agitating member being operable to rotate so as to agitate the toner in the toner replenishment device, wherein the agitating blade is positioned near the toner detector over certain rotational angles of the agitating member;

a position detector configured to generate a signal indicative of a rotational position of the agitating member; and a recognition unit configured to recognize the rotational position of the agitating member based on the signal output from the position detector, wherein the toner feed unit is operable to feed the toner into the toner replenishment device when a position of an end edge of the agitating blade is within a specified range based on the recognition performed by the recognition unit, the agitating blade not blocking a flow path of the toner from the toner receiving port to the toner detector while the end edge thereof is in the specified range, wherein the specified range is set to a range from one position to another position of the end edge of the agitating blade, the one position being a position that is spaced away from a position at which the end edge of the agitating blade comes closest to a lower end of the toner detector by a first specified angle in a direction away from the toner detector, the other position being a position that is spaced away from a position at which the end edge of the agitating blade comes closest to an upper end of the toner detector by a second specified angle in a direction away from the toner detector.

2. The toner replenishment device according to claim 1, further comprising:

a storage unit that stores data, wherein the position detector is an encoder, and wherein the recognition unit recognizes a present rotational position as a rotation angle of the agitating member based on a predetermined reference position of the agitating member, data stored in the storage unit, the data being indicative of the number of pulses output from the encoder while the agitating member performs one rotation, and the number of pulses output from the encoder, the number of pulses being counted from a pulse corresponding to the reference position.

3. The toner replenishment device according to claim 2, wherein the storage unit stores the number of pulses output from the encoder.

4. The toner replenishment device according to claim 1, further comprising: a reference position detection sensor that detects passage of a reference point provided in a gear, the gear rotating the agitating member, and wherein the recognition unit recognizes the rotational position as a rotation angle of the agitating member based on data stored in a storage unit, the data being indicative of the number of pulses output from an encoder while the agitating member performs one rotation, and the number of pulses output from the encoder, the number of pulses being counted from a pulse corresponding to detection of the reference point, the detection being performed by the reference position detection sensor.

5. The toner replenishment device according to claim 1, further comprising:

a control unit, wherein, when the toner is fed into the toner replenishment device, the control unit causes the agitating member to stop.

6. The toner replenishment device according to claim 1, further comprising:

a control unit, wherein, when the control unit recognizes that the toner needs to be fed into the toner replenishment device and a position of the end edge of the agitating blade is out of the specified range, the control unit causes the agitating member to rotate so as to move the position of the end edge of the agitating blade to a position within the specified range.

7. The toner replenishment device according to claim 1, further comprising:

a replenishment screw, wherein the agitating member is rotatable in forward and reverse rotation directions, wherein, when the agitating member rotates in the forward rotation direction, the replenishment screw rotates with the agitating member, and wherein, when the agitating member rotates in the reverse rotation direction, the replenishment screw does not rotate.

8. An image forming apparatus comprising:

an image bearing member configured to bear a toner image on a circumferential surface thereof;

a developing device configured to develop an electrostatic latent image formed on the circumferential surface of the image bearing member so as to form the toner image;

a transfer section configured to transfer the toner image onto a sheet;

a fixing unit configured to fix the toner image onto the sheet, in the event that the toner image has been transferred onto the sheet;

a toner containing body that contains toner; and a toner replenishment device for coupling to the toner containing body that receives the toner from the toner containing body and delivers the toner to the developing device, wherein the toner replenishment device includes a toner receiving port through which the toner is selectively fed into the toner replenishment device, a toner feed unit configured to feed the toner from the toner receiving port into the toner replenishment device, a toner detector configured to be used for detecting, by interaction with the toner, whether the toner replenishment device has been filled with a specified amount of the toner;

an agitating member having an agitating blade, the agitating member being operable to rotate so as to agitate the toner in the toner replenishment device, wherein the agitating blade is positioned near the toner detector over certain rotational angles of the agitating member;

a position detector configured to generate a signal indicative of a rotational position of the agitating member; and a recognition unit configured to recognize the rotational position of the agitating member based on the signal output from the position detector, wherein the toner feed unit is operable to feed the toner into the toner replenishment device when a position of an end edge of the agitating blade is within a specified range based on the recognition performed by the recognition unit, the agitating blade not blocking a flow path of the toner from the toner receiving port to the toner detector while the end edge thereof is in the specified range, wherein, the specified range is set to a range from one position to another position of the end edge of the agitating blade, the one position being a position that is spaced away from a position at which the end edge of the agitating blade comes closest to a lower end of the toner detector by a first specified angle in a direction away from the toner detector, the other position being a position that is spaced away from a position at which the end edge of the agitating blade comes closest to an upper end of the toner detector by a second specified angle in a direction away from the toner detector.

9. The image forming apparatus according to claim 8, further comprising:

a storage unit that stores data, wherein the position detector is an encoder, and wherein the recognition unit recognizes a present rotational position as a rotation angle of the agitating member based on a predetermined reference position of the agitating member, data stored in the storage unit, the data being indicative of the number of pulses output from the encoder while the agitating member performs one rotation, and the number of pulses output from the encoder, the number of pulses being counted from a pulse corresponding to the reference position.

10. The image forming apparatus according to claim 9, wherein the storage unit stores the number of pulses output from the encoder.

11. The image forming apparatus according to claim 8, further comprising: a reference position detection sensor that detects passage of a reference point provided in a gear, the gear rotating the agitating member, and wherein the recognition unit recognizes the rotational position as a rotation angle of the agitating member based on data stored in a storage unit, the data being indicative of the number of pulses output from an encoder while the agitating member performs one rotation, and the number of pulses output from the encoder, the number of pulses being counted from a pulse corresponding to detection of the reference point, the detection being performed by the reference position detection sensor.

12. The image forming apparatus according to claim 8, further comprising:

a control unit, wherein, when the toner is fed into the toner replenishment device, the control unit causes the agitating member to stop.

13. The image forming apparatus according to claim 8, further comprising:

a control unit, wherein, when the control unit recognizes that the toner needs to be fed into the toner replenishment device and a position of the end edge of the agitating blade is out of the specified range, the control unit causes the agitating member to rotate so as to move the position of the end edge of the agitating blade to a position within the specified range.

14. The image forming apparatus according to claim 8, further comprising:

a replenishment screw, wherein the agitating member is rotatable in forward and reverse rotation directions, wherein, when the agitating member rotates in the forward rotation direction, the replenishment screw rotates with the agitating member, and wherein, when the agitating member rotates in the reverse rotation direction, the replenishment screw does not rotate.

* * * * *